US007819563B2

(12) United States Patent
Hardgrave

(10) Patent No.: US 7,819,563 B2
(45) Date of Patent: Oct. 26, 2010

(54) FAN CHANDELIER

(76) Inventor: Eric Neal Hardgrave, 1234 Boardwalk St., Arlington, TX (US) 76011

( * ) Notice: Subject to any disclaimer, the term of this patent is extended or adjusted under 35 U.S.C. 154(b) by 0 days.

(21) Appl. No.: 11/378,209

(22) Filed: Mar. 16, 2006

(65) Prior Publication Data

US 2006/0209532 A1 Sep. 21, 2006

Related U.S. Application Data

(60) Provisional application No. 60/663,479, filed on Mar. 16, 2005.

(51) Int. Cl.
*F21S 8/06* (2006.01)

(52) U.S. Cl. ..... 362/406; 362/294; 362/373

(58) Field of Classification Search ..... 362/294, 362/373, 404–406, 806
See application file for complete search history.

(56) References Cited

U.S. PATENT DOCUMENTS

| | | | | | |
|---|---|---|---|---|---|
| 1,889,567 | A | | 11/1932 | Persons | |
| 2,130,802 | A | * | 9/1938 | Kisling | 415/8 |
| 2,258,731 | A | | 10/1941 | Blumenthal | 230/249.5 |
| 3,786,575 | A | | 1/1974 | Riblett | 34/99 |
| 4,356,535 | A | | 10/1982 | Chu | 362/35 |
| 4,521,153 | A | * | 6/1985 | Morimoto et al. | 415/146 |
| 4,711,161 | A | | 12/1987 | Swin, Sr. et al. | 98/31.5 |
| 4,773,310 | A | * | 9/1988 | Corwin | 454/244 |
| 4,926,293 | A | | 5/1990 | Saba | 362/96 |
| 5,422,795 | A | | 6/1995 | Liu | 362/96 |
| 5,664,872 | A | | 9/1997 | Spearman et al. | 362/96 |
| 5,664,996 | A | * | 9/1997 | Wang et al. | 454/210 |
| 5,668,920 | A | * | 9/1997 | Pelonis | 392/361 |
| 5,746,495 | A | * | 5/1998 | Klamm | 362/577 |
| 5,934,783 | A | | 8/1999 | Yoshikawa | 362/96 |
| 6,089,726 | A | | 7/2000 | Eldridge, Jr. | 362/96 |
| 6,160,956 | A | | 12/2000 | Pelonis | 392/361 |
| 6,193,602 | B1 | * | 2/2001 | Aprea | 454/208 |
| 6,213,617 | B1 | * | 4/2001 | Barker | 362/96 |
| 6,244,720 | B1 | | 6/2001 | Neff | 362/96 |
| 6,364,638 | B1 | * | 4/2002 | Liu | 417/423.15 |
| 6,382,808 | B1 | | 5/2002 | Lin | 362/96 |
| 6,644,837 | B2 | * | 11/2003 | Borders et al. | 362/399 |
| 2002/0030992 | A1 | * | 3/2002 | Lefebvre et al. | 362/243 |
| 2002/0192077 | A1 | * | 12/2002 | Tsuji | 416/5 |
| 2004/0141328 | A1 | * | 7/2004 | Stone et al. | 362/405 |
| 2004/0191066 | A1 | * | 9/2004 | Chen | 416/210 R |

* cited by examiner

*Primary Examiner*—Jong-Suk (James) Lee
*Assistant Examiner*—Julie A Shallenberger
(74) *Attorney, Agent, or Firm*—Guy V. Manning

(57) ABSTRACT

A fan chandelier having a central body bearing lighting units with built-in fans, the lighting units preferably disposed at the ends of arms arrayed radially in satellite fashion about the central body. The central body, which also or alternatively may include lights and a fan, distributes power to drive all the fans and lights. The fans concealed within the satellite lighting units preferably have separately controllable, individual electric motors and may include heater strips to warm the air. In an alternate embodiment, the satellite fans may couple through flexible cables and a transmission within the central body to a single motor. The entire array creates air movement as effective as that of a ceiling fan of similar size, while also lighting a room in a fashion aesthetically pleasing enough to serve as a chandelier, complete with optional light refracting crystals.

31 Claims, 25 Drawing Sheets

FAN CHANDELIER

This application is a continuation-in-part of Provisional Application Ser. No 60/663,479 filed Mar. 16, 2005.

BACKGROUND OF THE INVENTION

1. Field of the Invention

This invention relates generally to chandeliers, and particularly to chandeliers having built-in air handlers to provide both light and air movement in a single unit. More particularly, this invention relates to a chandelier having multiple light fixtures arrayed around a central body in satellite fashion, the chandelier having one or more built-in fans.

2. Description of Related Art

Chandeliers comprise decorative, sometimes exceptionally attractive lighting fixtures usually stationed in large gathering rooms such as entry vestibules or ballrooms. In residential settings, large chandeliers often grace living, dining and occasionally other rooms by hanging from the ceiling in the center of the room. Though very attractive and often quite efficient at lighting such rooms, chandeliers traditionally have no provision for circulating air within the rooms except for the relatively small amount of convection due to air warmed near the lights.

Ceiling fans likewise serve similar purposes to chandeliers. Typically mounted in the center of the room, ceiling fans comprise a central electric motor rotating a plurality of angled blades arrayed radially around the fan. Light fixtures affixed to the underside of the motor often provide optional, sometimes decorative lighting while the rotating blades create substantial air movement. Ceiling fans typically move air to cool a room, and provide no means for warming the air.

Ceiling fans usually are selected in lieu of chandeliers when air movement is desired and lighting is of secondary importance. Chandeliers, by contrast, usually are selected when attractive lighting is the primary motive, and air movement is secondary or provided by other means. A need exists for a fixture that may serve both motives simultaneously.

SUMMARY OF THE INVENTION

Accordingly, it is an object of this invention to provide a chandelier which creates air movement.

It is another object of this invention to provide a chandelier which includes air movement devices.

It is another object of this invention to provide a chandelier that regulates the temperature of air as it moves through the chandelier.

It is another object of this invention to provide an air movement device which is aesthetically attractive.

It is yet another object of this invention to provide an air movement fixture sufficiently attractive to serve as a chandelier.

The foregoing and other objects of this invention are achieved by providing a fan chandelier having a central body bearing lighting units with built-in fans, the lighting units preferably disposed at the ends of arms arrayed radially in satellite fashion about the central body. The central body, which also or alternatively may include lights and a fan, distributes power to drive all the fans and lights. The fans concealed within the satellite lighting units preferably have separately controllable, individual electric motors and may include heater strips to warm the air. In an alternate embodiment, the satellite fans may couple through flexible cables and a transmission within the central body to a single motor. The entire array creates air movement as effective as that of a ceiling fan of similar size, while also lighting a room in a fashion aesthetically pleasing enough to serve as a chandelier, complete with optional light refracting crystals.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
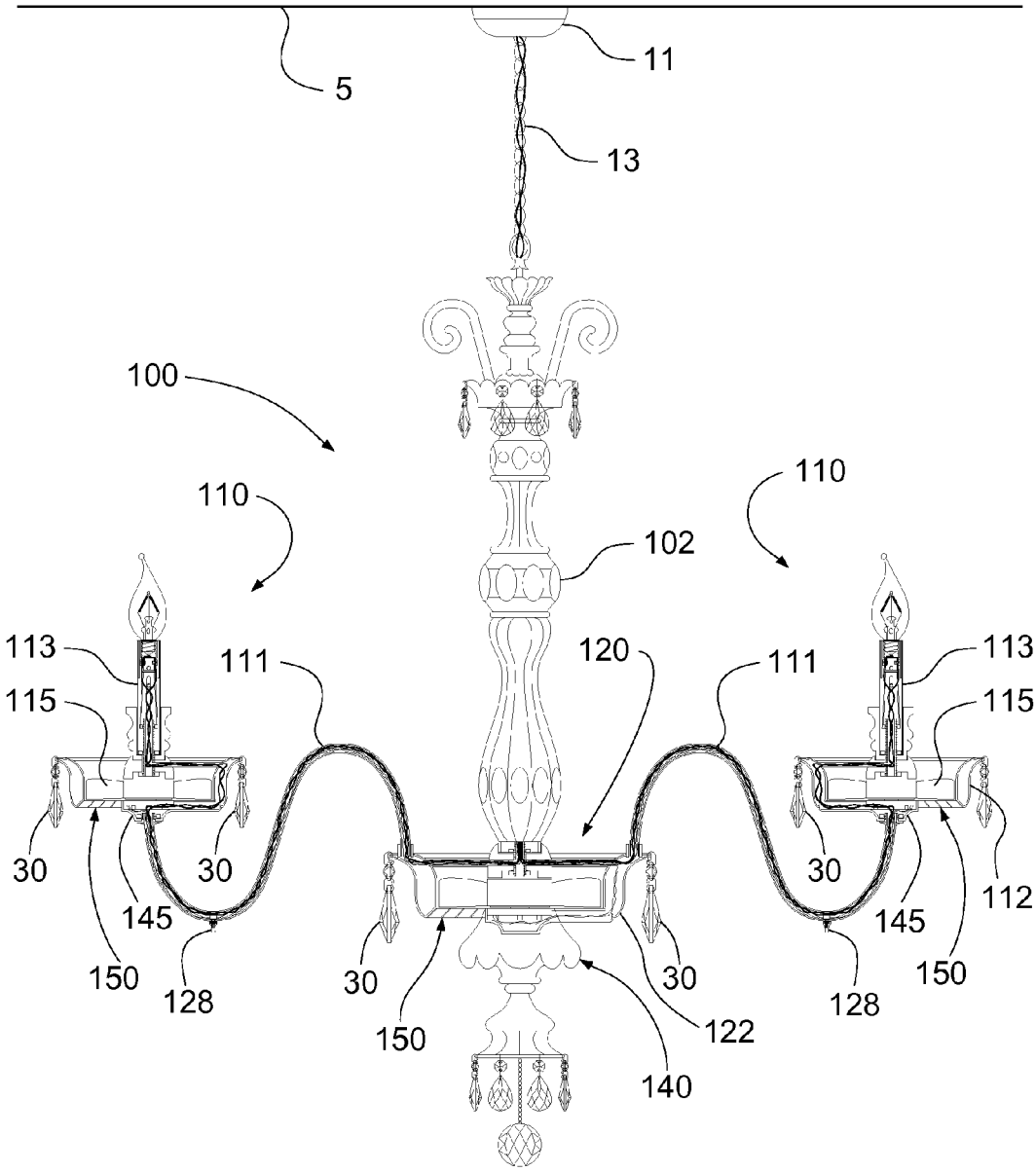
FIG. 1 depicts a preferred embodiment of the fan chandelier of the present invention having a central body and satellite light fixtures both bearing electrically driven fans.

With reference now to the figures, and in particular to FIGS. 1-5B, fan chandelier 100 comprises central body 102 depending from ceiling 5 at mount 11 by suspension means 13 (such as a chain or rigid mast). Disposed at the bottom of central body 102 opposite chain 13, central fan unit 120 includes shroud 122 encircling fan 125 and supporting the ends of arms 111 proximate central body 102. Base 140 depending from fan unit 120, discussed in more detail below, serves in part to disperse air flowing downward from fan 125.

Figure 4A:
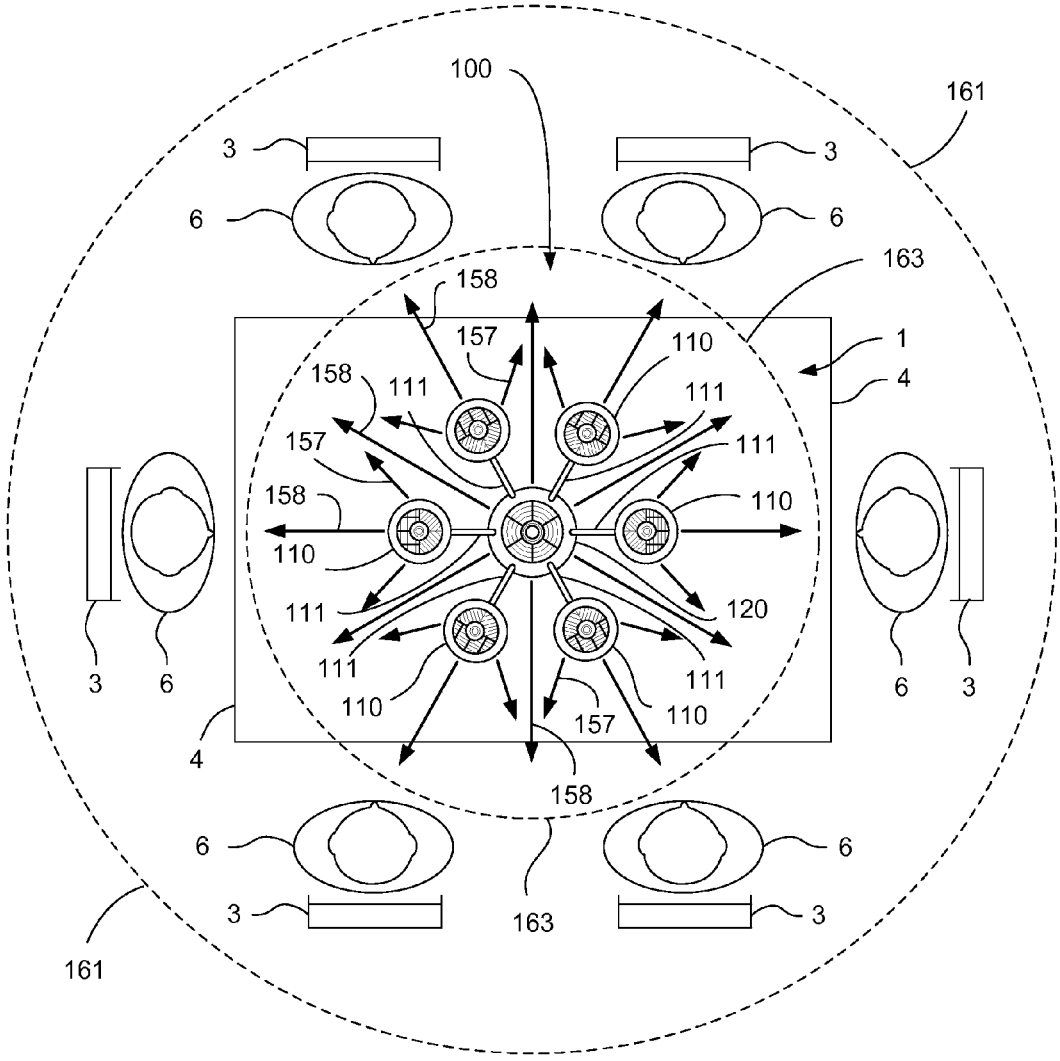
FIG. 4A shows a plan view of the chandelier fan of FIG. 1 suspended above a dining table with surrounding seating.

As seen best in FIG. 4A, fan chandelier 100 further comprises a plurality of satellite units 110 arrayed radially on arms 111 and evenly encircling central body 102 above dining table 1 and seating 3. Satellites 110 also may be disposed in more than one plane (fan chandelier 105 in FIG. 5A) and at different radial distances from central body 102. Each of satellites 110 is supported by base 145 or 146 disposed at the end of arm 111 opposite central body 102. Shroud 112 surrounds satellite fan 115 and supports light unit 113 disposed axially above base 145, 146.

Fan chandeliers 100, 105 suspend centrally above table 1 such that satellites 110 extend substantially evenly toward all sides of table 1 where seats 3 are disposed just beyond edge 4 thereof. Optimally, central body 102 reaches downward from ceiling 5 to within approximately thirty to thirty-four (30"-34") inches above the top of table 1, with satellites 110 extending horizontally therefrom to within approximately six (6") to twelve (12") inches inside perimeter 4 of table 1.

Fans 115, 125 spin in one or more horizontal planes to impel air vertically above table 1 within region of influence 161 (FIGS. 4A, 5A), while light units 113 provide illumination to table 1. Crystals 30 optionally disposed around central body 102 and satellites 110 refract and disperse light from light units 113 as expected of chandeliers generally. Fan chandeliers 100, 105 thus provide both aesthetically pleasing lighting to diners 6 seated around table 1 while simultaneously creating air movement within region 161, as discussed in more detail below.

Figure 2A:
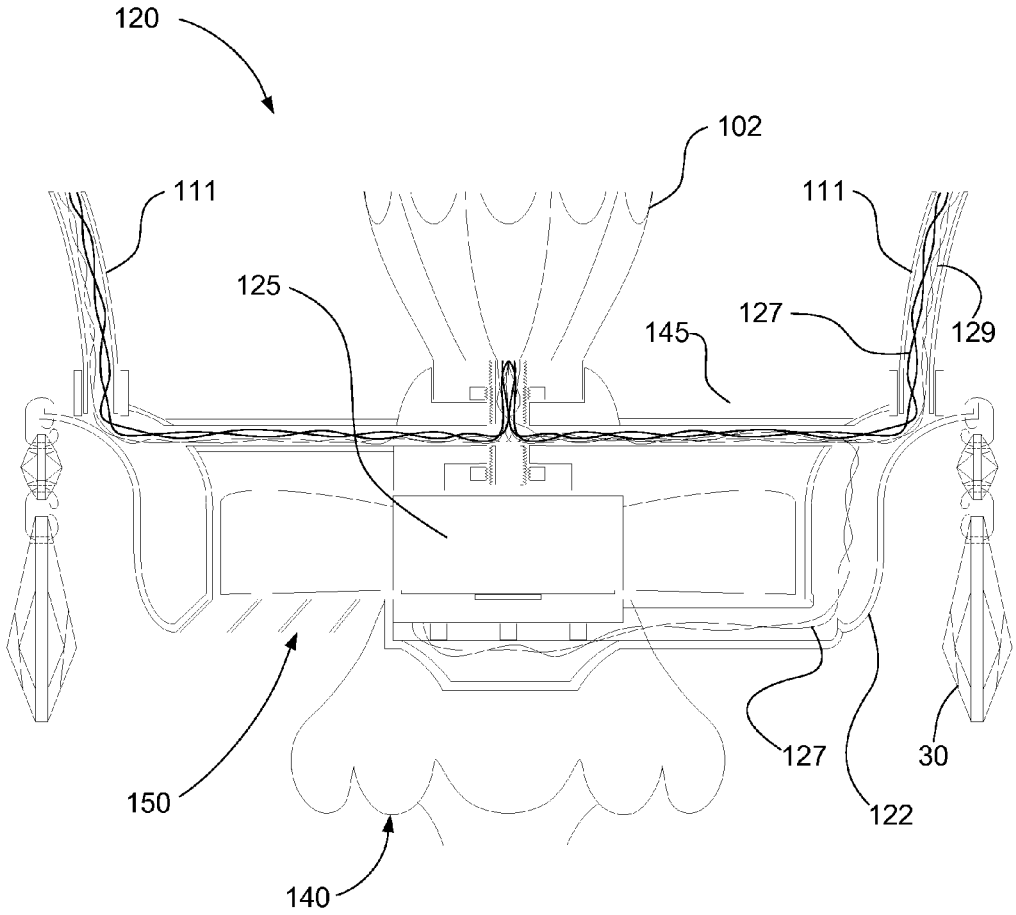
FIGS. 2A, 2B detail in partial cross sections alternative embodiments of fan units in the central body of the invention shown in FIG. 1.
Figure 2B:
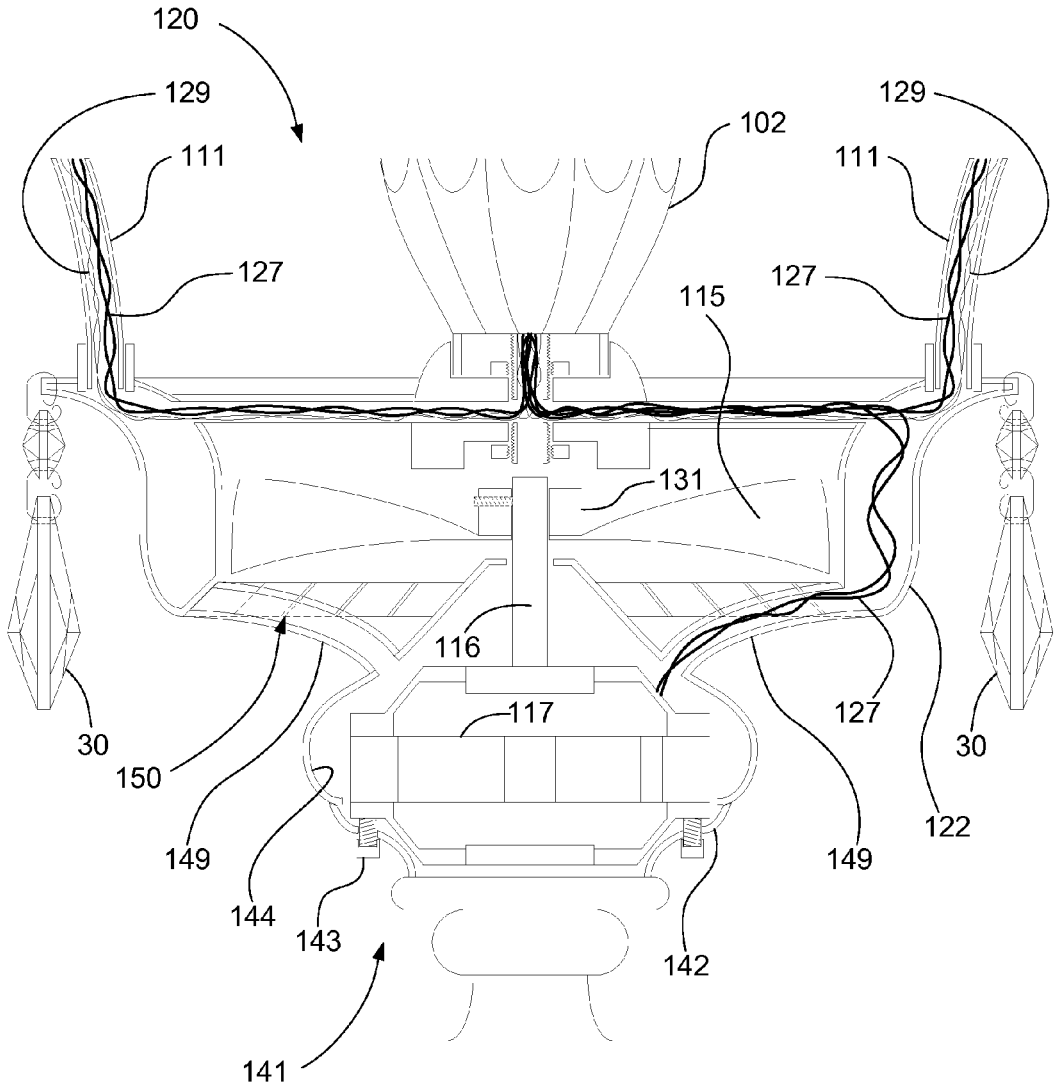

As best seen in FIGS. 2A-2B, central fan unit 120 includes shroud 122 which supports the ends of arms 111 proximate central body 102. Shroud 122 comprises a substantially vertical, hollow cylinder adapted to channel air around central body 102 and base 140. Shroud 122 also surrounds central fan 125 which rotates in a horizontal plane and coaxial with central body 102. In the preferred embodiment of FIG. 2A, case style fan 125 includes motor 117 coplanar with the blades of fan 125, and base 140, if present at all, is largely decorative, but also serves to partially disperse air from fan 125.

As depicted in FIG. 2B, alternate base 141 comprises an enlarged, hollow, globular object suspended by wings 149 from shroud 122. Base 141 includes interior 144 which surrounds, encloses and conceals electric motor 117. Motor 117 is supported by motor mounts 143 within chamber 144 above belly 142, and shaft 116 extends upward through body 141 to couple to hub 131 of fan 125. At least one of wings 149 provides a hollow path for fan motor wiring 127 extending to motor 117 from central body 102.

Figure 3A:
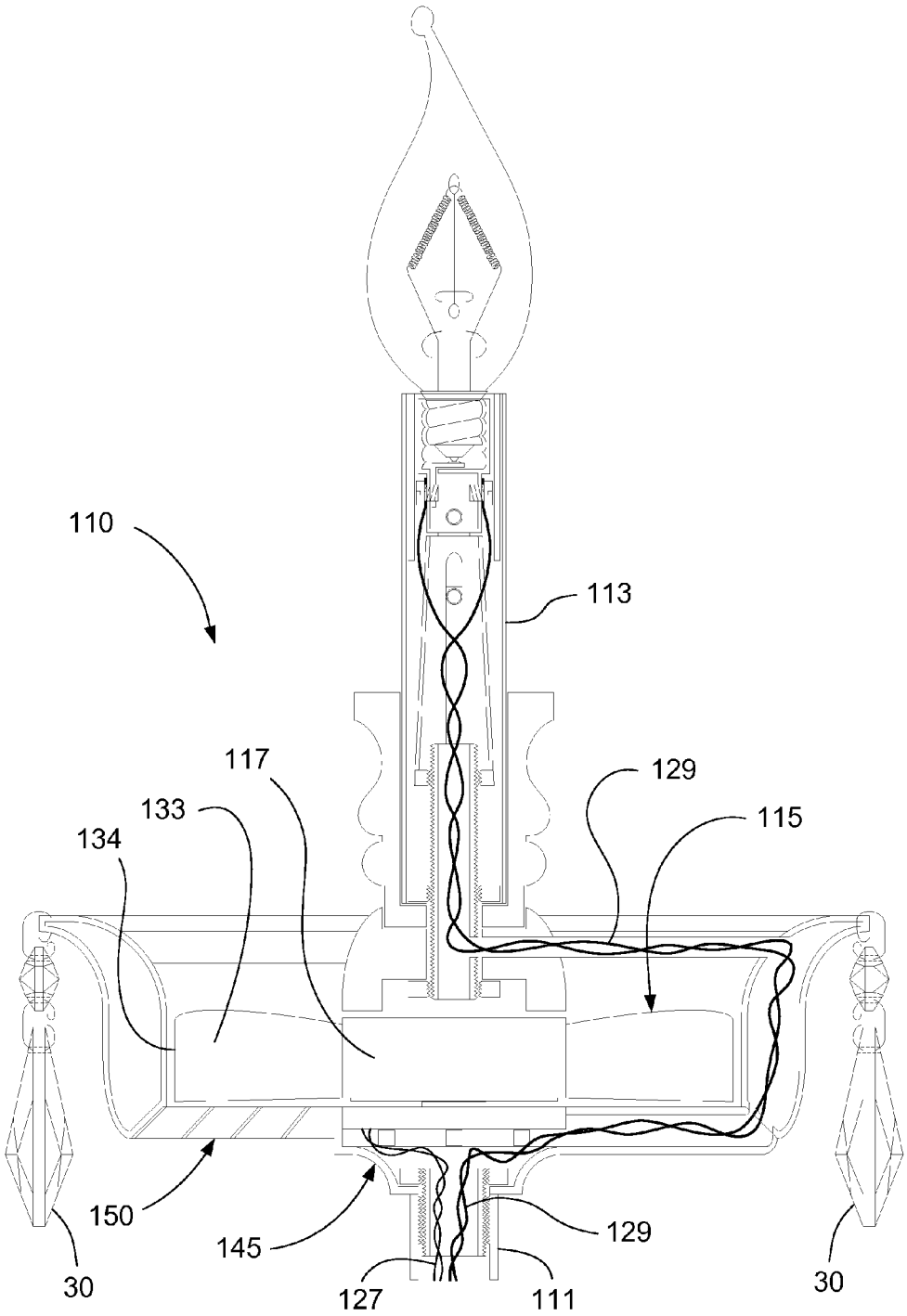
FIGS. 3A-3C detail in partial cross sections several embodiments of satellite fan and lighting units for the invention shown in FIG. 1.
Figure 3B:
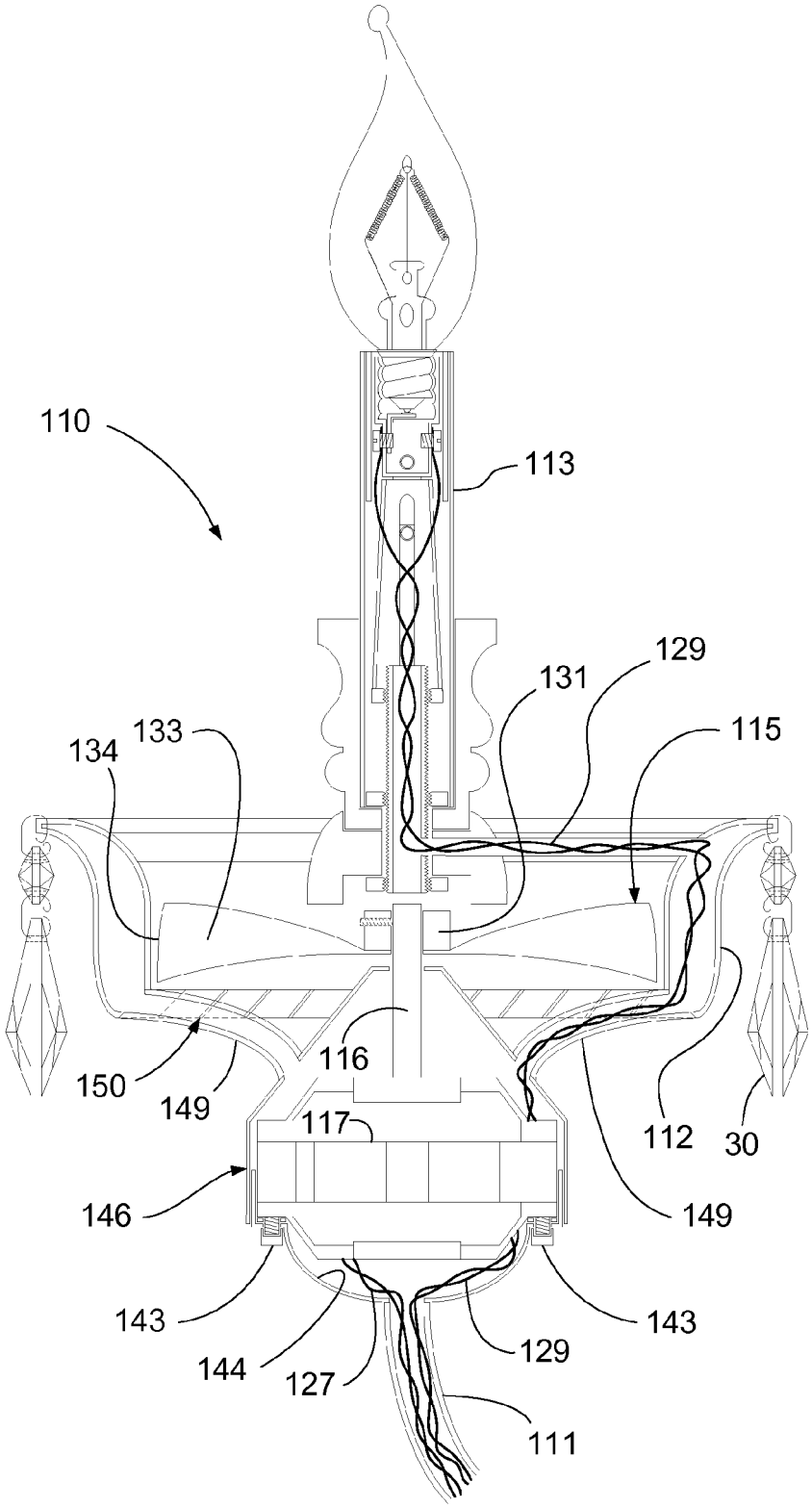
Figure 3C:
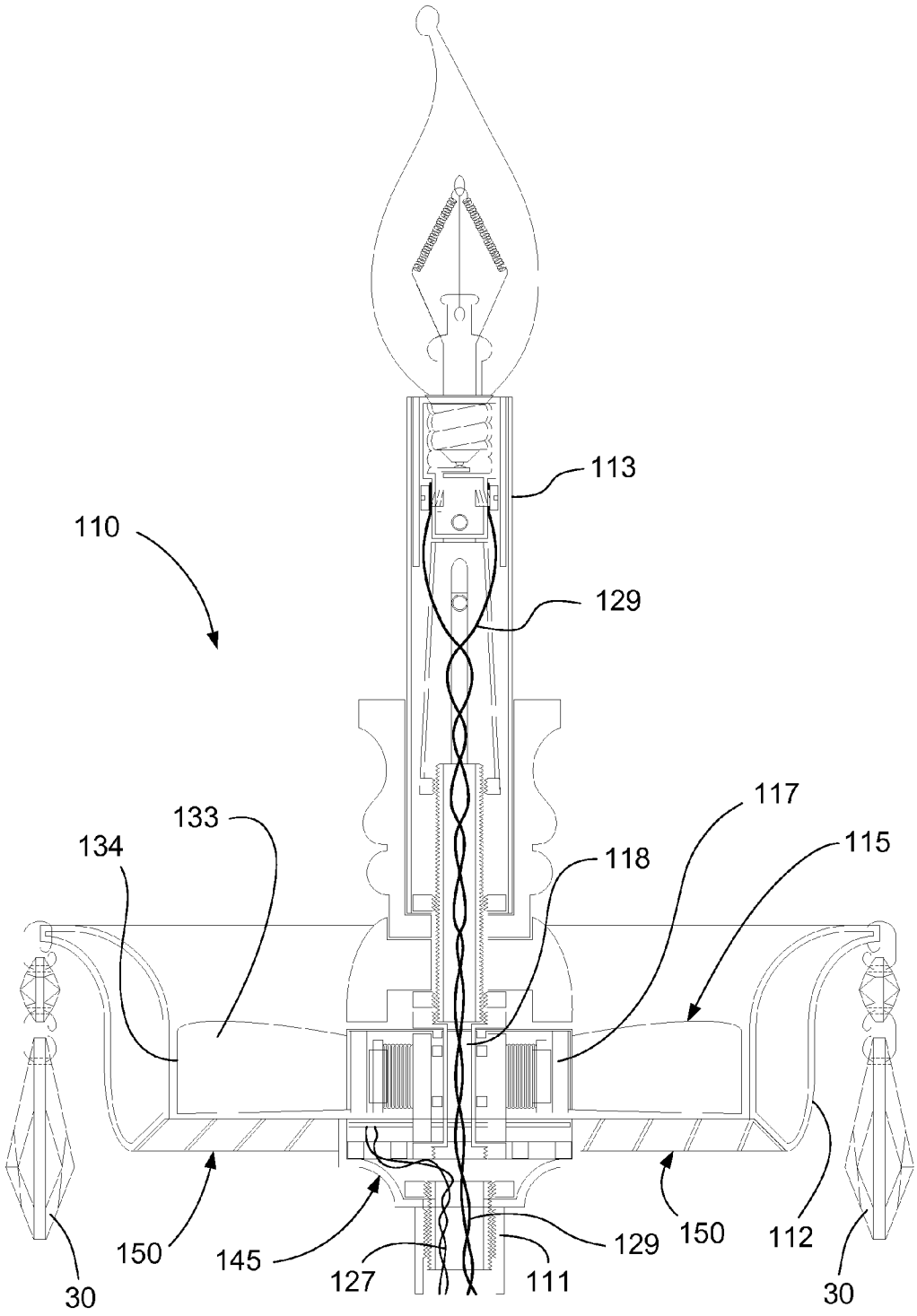

As seen in FIGS. 3A-3C, each of satellite units 110 also includes base 145 disposed on the distal ends of arms 111. Preferably, as with central fan unit 120, case style fan 115 includes motor 117 coplanar with fan 115. Base 145 serves primarily as structural support for satellite 110. As depicted in FIG. 3B, however, enlarged alternate base 146 encloses motor 117, as discussed above for alternate base 141 for central fan unit 120.

Arms 111 also serve as ducts for wiring 127, 129 extending from central body 102 to satellites 110 to power fans 115 and lights 113 respectively. While motor wire 127 stops within base 145 to serve motor 117, light wiring 129 extends to lights 113 above shroud 112 by one of two routes. As depicted in FIG. 3A, shroud 112 surrounding fan 115 provides a hollow path for lighting wiring 129 similarly to the way motor wiring 127 reaches motor 117 in central fan unit 120 (FIGS. 2A, 2B) In FIG. 3C, alternate fan 115 includes coaxial motor 117 having hollow axial channel 118 for light wiring 129 to pass through to light 113, obviating the need to run wiring 129 through shroud 112.

Electrically Driven Fans

Continuing now with FIGS. 1-3C, fans 115, 125 preferably are driven by electric motors 117 (FIGS. 2A-3C) for quietness, ease of construction and efficiency of operation. As mentioned above, fans 115, 125 preferably comprise radial blade, bi-directional, 120 volt A/C fans having motor 117 coaxial with hub 131 and with blades 133 which terminate in margins 134 opposite hub 131. A suitable fan 115, 125 of this type is available as catalog number NMB-MAT 5915PC-12T-B20-A00 (central fan 125) or NMB-MAT 4715FS-12T-B50-D00 (satellite fan 115) from NMB, Inc. of Chatsworth, Calif. Alternate fans 115, 125 having separate motors 117 concealed within bases 141, 146 preferably are axial propeller fans (10 wing) available as catalog number AD10-5.00-CC-B-37-0.25 from Air-Drive, Inc. of Gurnee, Ill., used with motor 117 available as catalog number 2M566 from W. W. Grainger, Inc., of Chicago, Ill., USA.

Electric power to fans 115, 125 preferably is provided by wires 127 (FIGS. 1, 2A) extending from control switches located conveniently within the room (not shown) through ceiling 5 and mast 13 into shroud 122 to central fan 125. Wires 127 optionally also could power satellite fans 115 by simply branching within base 140 (not shown) and extending through arms 111 to each of satellites 110. In such case, controlling the speed of central fan 125 necessarily would control proportionally the speed of satellite fans 115.

Preferably, however, separate controls for fans 115 are provided for each satellite 110 so that each of fans 115 may be controlled separately not only from central fan 125 but also from each other. Switches 128 disposed on arms 111 (FIG. 1) provides such control. Switch 128 preferably comprises a rheostat capable of regulation the speed of fan 115 and is mounted within easy reach of diner 6 from seat 3. This gives each diner 6 the option to optimize air flow 157, 158 directed toward himself by adjusting the speed of fan 115 nearest him.

Circuitry controlling fans 115, 125 and lights 113 is conventional within the electrical arts and unnecessary to detail herein. It will be recognized, however, that switches controlling fans 115, 125 and lights 113 may be either simple on/off switches capable of switching inductive loads or rheostats that provide continuously variable control. All such wiring 127-129 will be of appropriate size, voltage and frequency generally known and available for the installation (typically 120 volts, 60 cycles in the United States) to provide ample power to their respective devices.

Fans 115, 125 have been discussed above as being 120 volt A/C powered, but they also could comprise 24 or 48 volt D/C motors supplied from a separate power supply (not shown). Such power supply could be incorporated within central body 102 or base 141 disposed thereon (neither shown) or supplied as part of the building wiring (e.g. located above ceiling 5). One having ordinary skill in the art will recognize that all such variations are considered to be within the spirit and scope of the present invention.

Mechanically Driven Fans

Referring now to FIGS. 6-9, alternate fan chandelier 200 comprises central body 228 supported by mast 205 from ceiling mount 202. A single electric motor 201 within ceiling mount 202 rotates shaft 203 to drive transmissions 220 within housing 222. One having ordinary skill in the art will recognize that motor 201 need not necessarily be contained within mount 202, but could be carried within central body 228 (not shown) and thereby disposed closer to transmission 220 discussed in detail below. Housing 222 supports arms 211 bearing on their ends distal housing 222 satellite fan and light units 210. Satellites 210 include bases 240, fans 215 and lighting 213 as discussed above for the electric driven units 110. Fans 215, however, are driven without the need for electrical power to bases 240, as discussed below.

Disposed within housing 222, transmission 220 comprises a single drive gear 221 coupled to shaft 203. Coplanar satellite, or spur, gears 223 mesh with drive gear 221 and rotate simultaneously therewith to turn flexible drive cables 230 extending through arms 211 to satellites 210. Within each satellite 210, cable 230 extends coaxially with base 240 (FIG. 8) to terminate in spline 218 which meshes with hub 216 of fan 215. Rotation of shaft 203 thereby rotates drive gear 221, satellite gears 223, flex cables 230, spines 218 and fans 215, thereby operating all satellite fans 215 with a single motor 201.

In an alternate embodiment of satellite 210 (FIG. 9) where arm 211 does not approach satellite 210 coaxially with base 240, cable 230 instead meshes with differential 231, comprising beveled gears 235, 236. Differential 231 converts horizontal rotation of cable 230 into vertical rotation of spine 218. Spine 218 then extends upward to engage hub 216 as discussed above.

Motor 201 preferably comprises a permanent, split-capacitor, ⅛ horsepower, three speed induction motor adapted to turn at approximately 1075 rpm. Using a 2.8:1 drive ratio, spur gears 223, flexible cable 230 and hub 216 preferably turn at a maximum rotation of 3000 rpm. A suitable motor 201 is available from W.W. Grainger, Inc. of Chicago, Ill., USA, as catalog number 4UY17. Flexible cable 230 preferably is a bi-directional, flexible shaft cable. A suitable cable 230 is available from SS White Technologies, Inc., Piscataway, N.J., USA, as catalog number FR130SLPCC01800.

Where wiring must accompany cable 230 within arms 111, a hollow-core flexible cable is preferred to prevent cable 230 and wiring 127, 129 from interfering with each other. A suitable transmission 220 also is available from Suhner Manufacturing, Inc. of Rome, Ga. A suitable hollow-core cable is available as catalog number A-250-4143 from Suhner Manufacturing, Inc. of Rome, Ga.

Chart A shows availability of the foregoing and of additional suitable products which may be used for various components discussed herein.

Diffusers

Disposed coaxially with and immediately above bases 140, 141, 145, 146, 240, diffusers 150 define the air flow from satellites 110 and central fan unit 120. Depending upon the air flow pattern desired (see FIGS. 4A-5B), diffusers 150 utilize one of several grates 170, 180, 190, 195 or 198, each discussed in detail below. Diffusers 150 mount just below and coaxial with fans 115, 125 and utilize a select one of grates 170-198 depending upon the location on fan chandeliers 100, 105, 200 and upon their configuration. Diffusers 150 direct air flow as indicated by flow arrows 157, 158 in FIGS. 4A, 5A.

As depicted in FIG. 4A, differential flow direction arrows 157, 158 indicate not only the direction but also the volume of air flow from satellites 110. Larger arrows 158 indicate air flow substantially parallel to arms 111 and substantially radial from fan chandelier 100, while smaller arrows 157 represent significantly lesser air flow directed at an angle to axis A of each of arms 111. Such air flow expands the reach of air flow envelope 166 (FIG. 4B) while keeping it within the desired direction. Further, as indicated by shorter arrows 157, lateral air flow from one satellite 110 will flow at an angle to axes A and may encounter that from adjacent satellites 110, whereupon it can co-mingle therewith and may be partially redirected toward edge 4 of table 1. This arrangement provides a more uniform distribution of air flow over table 1 than would occur if air simply flowed following arrows 158 and parallel arms 111.

Figure 4B:
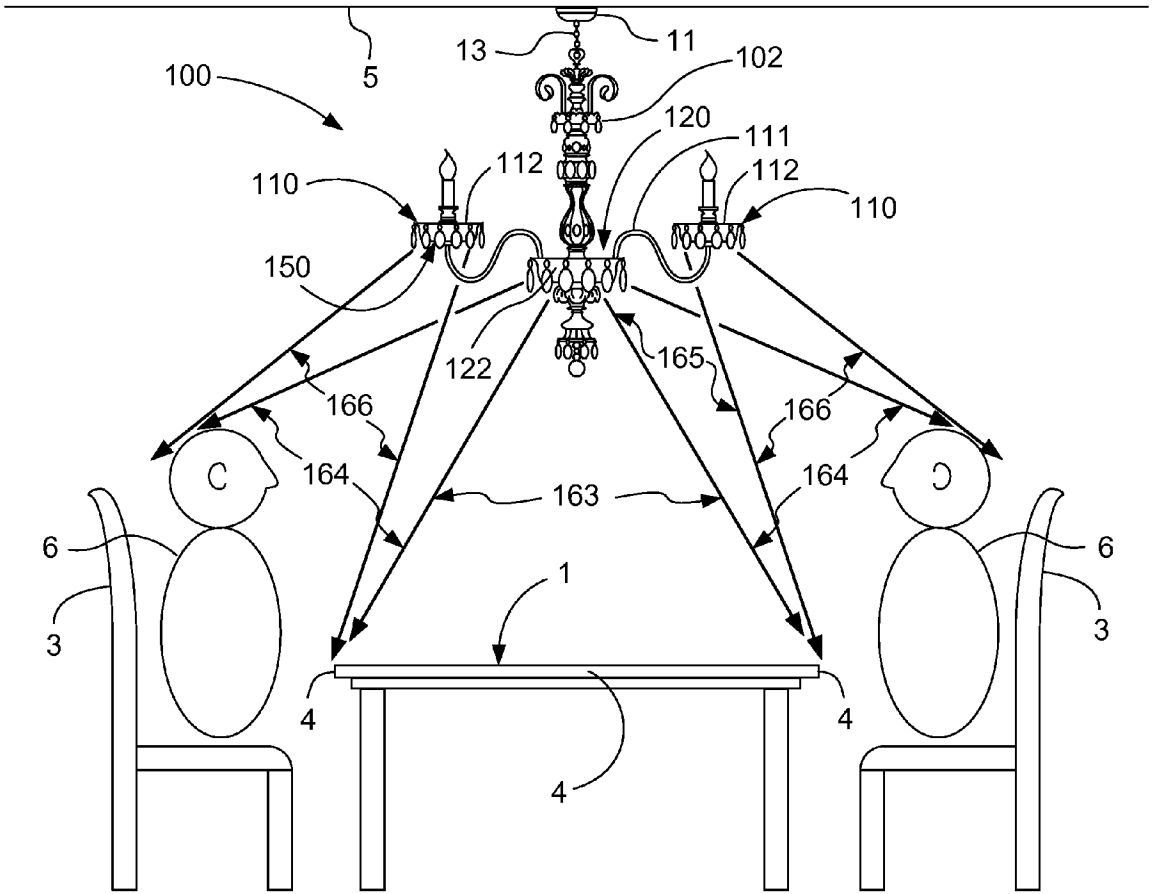
FIG. 4B shows a partial elevation of the chandelier and dining table arrangement of FIG. 4A.
Figure 5A:
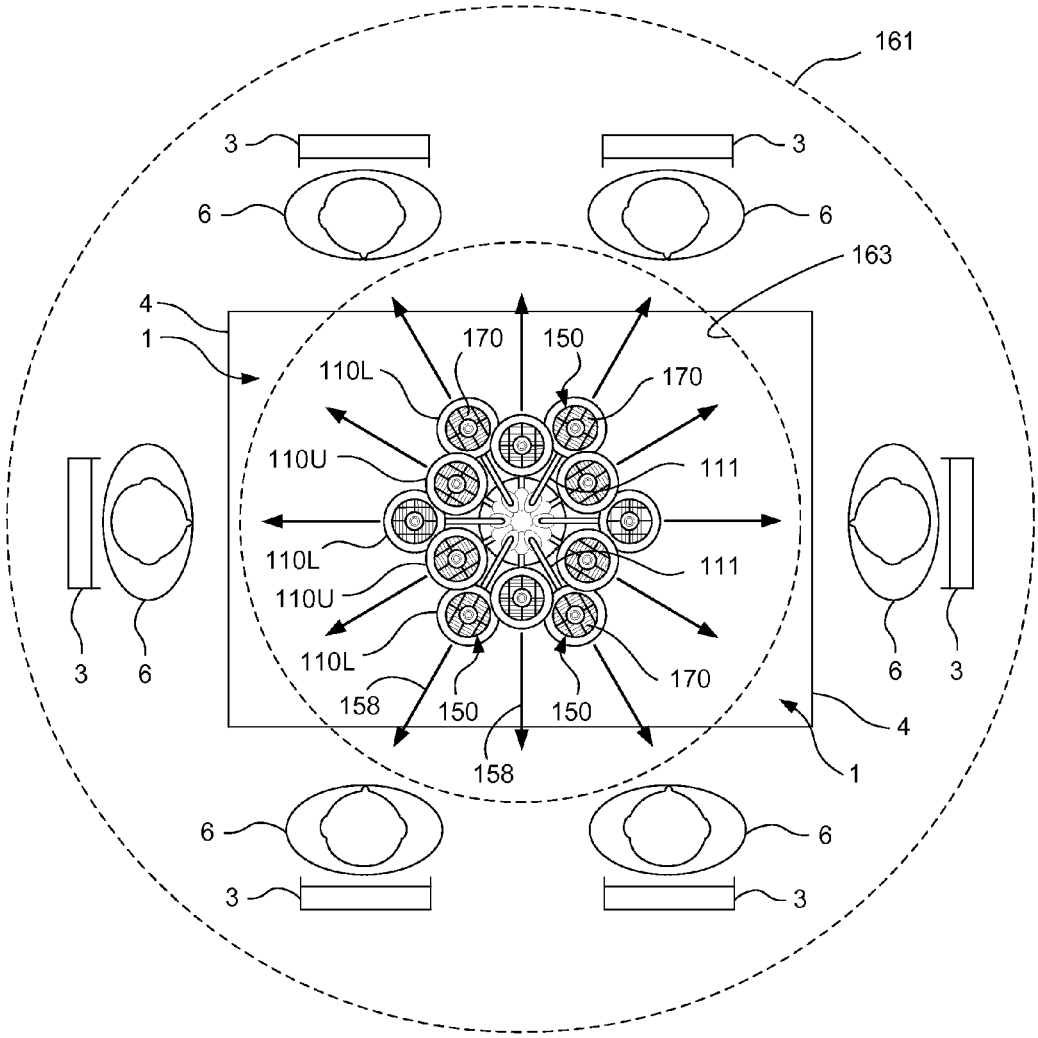
FIG. 5A shows a plan view of an alternate embodiment of the chandelier and dining table arrangement of FIG. 4A.
Figure 5B:
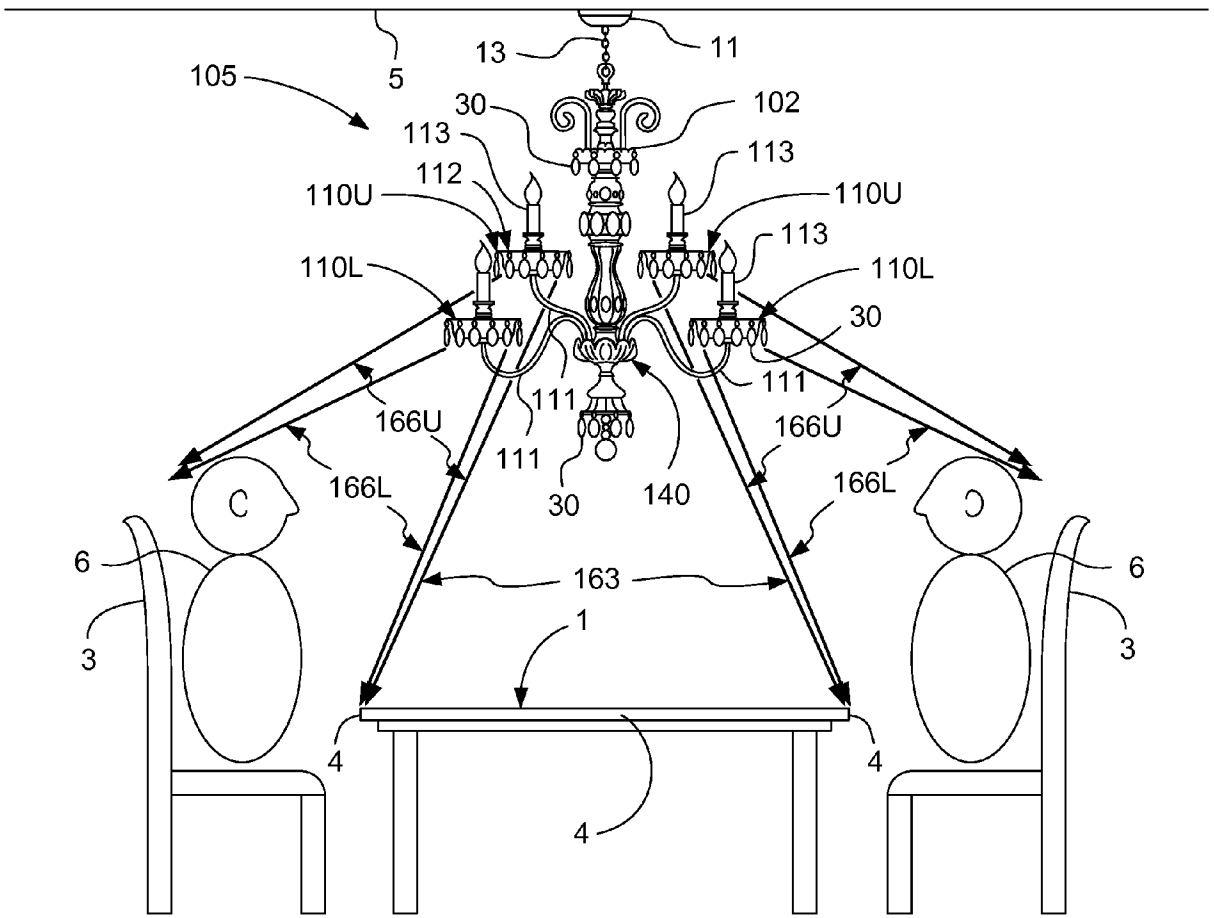
FIG. 5B shows a partial elevation of the chandelier and dining table arrangement of FIG. 5A.
Figure 6:
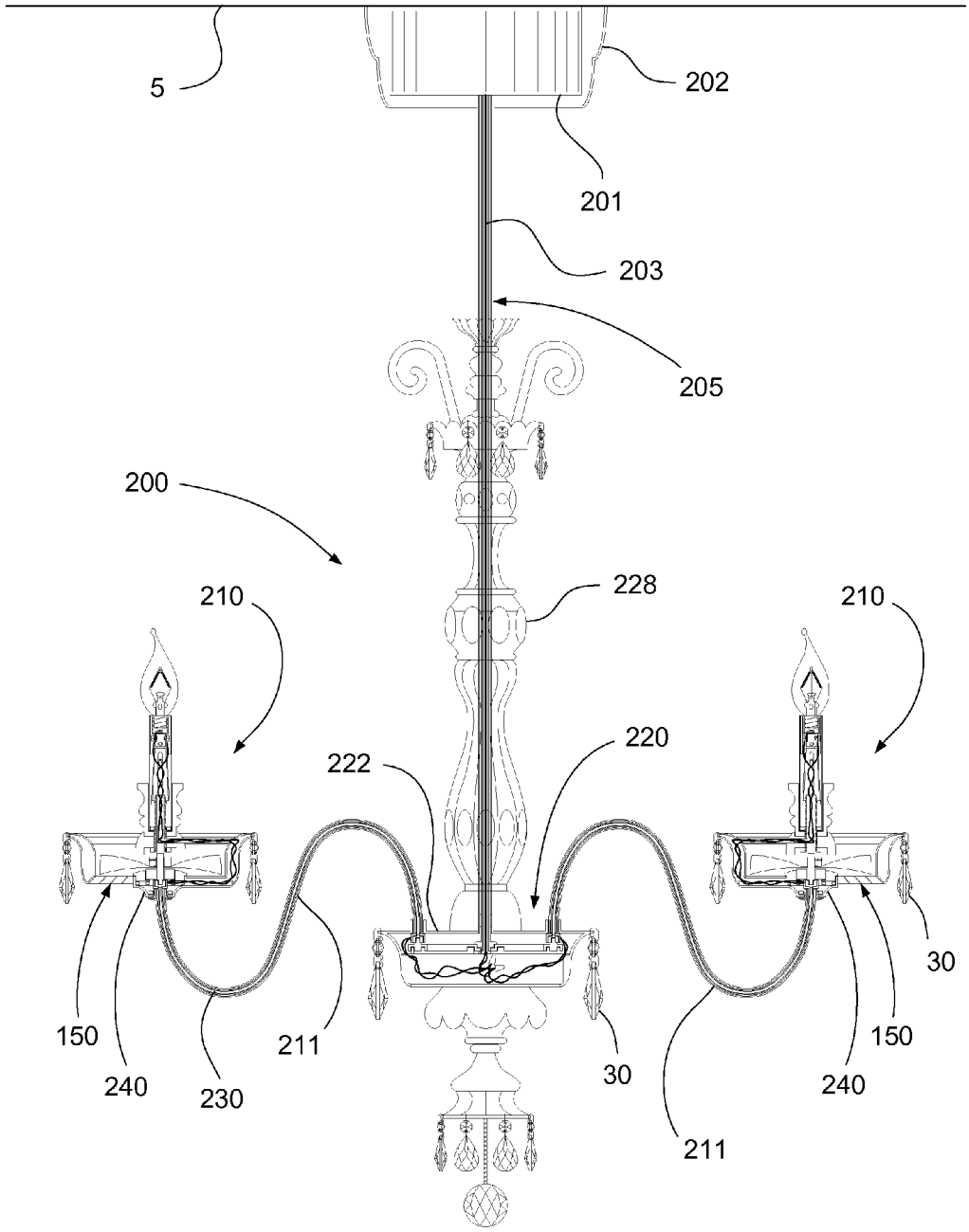
FIG. 6 depicts in elevational view an alternate embodiment of the chandelier fan of the present invention having a mechanical fan drive system.
Figure 7A:
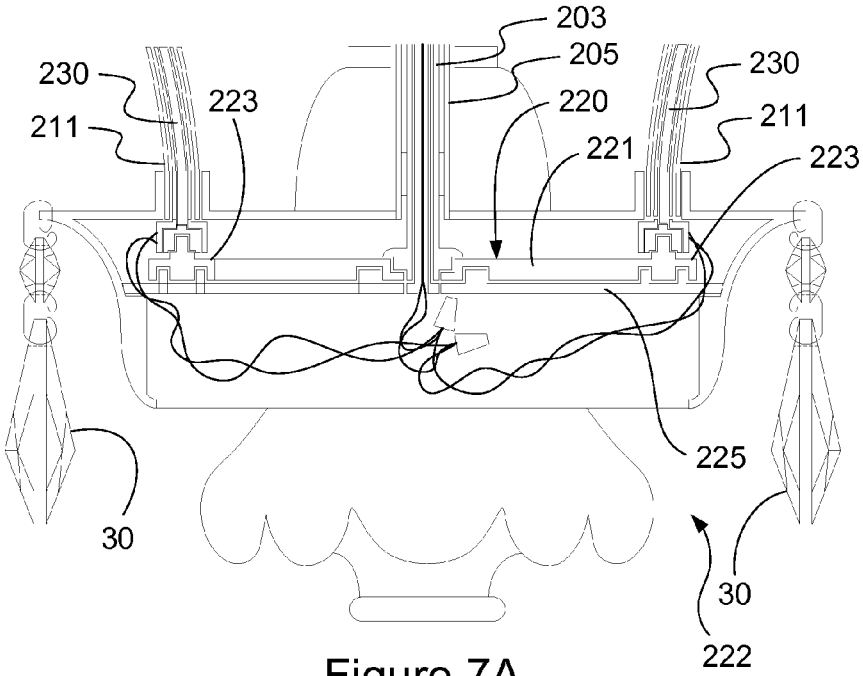
FIGS. 7A, 7B detail in partial cross section and plan views a transmission drive mechanism in the central body of the alternate embodiment of FIG. 6.
Figure 7B:
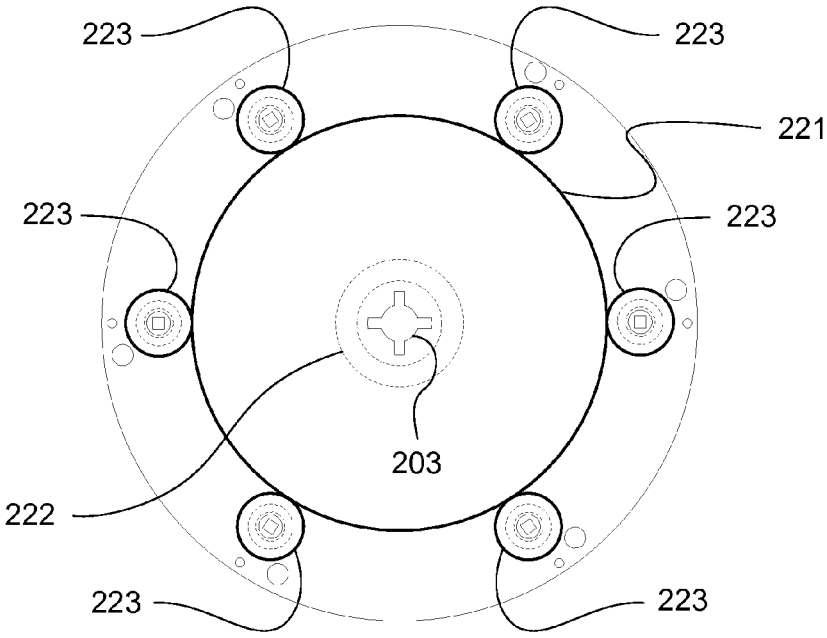
Figure 8:
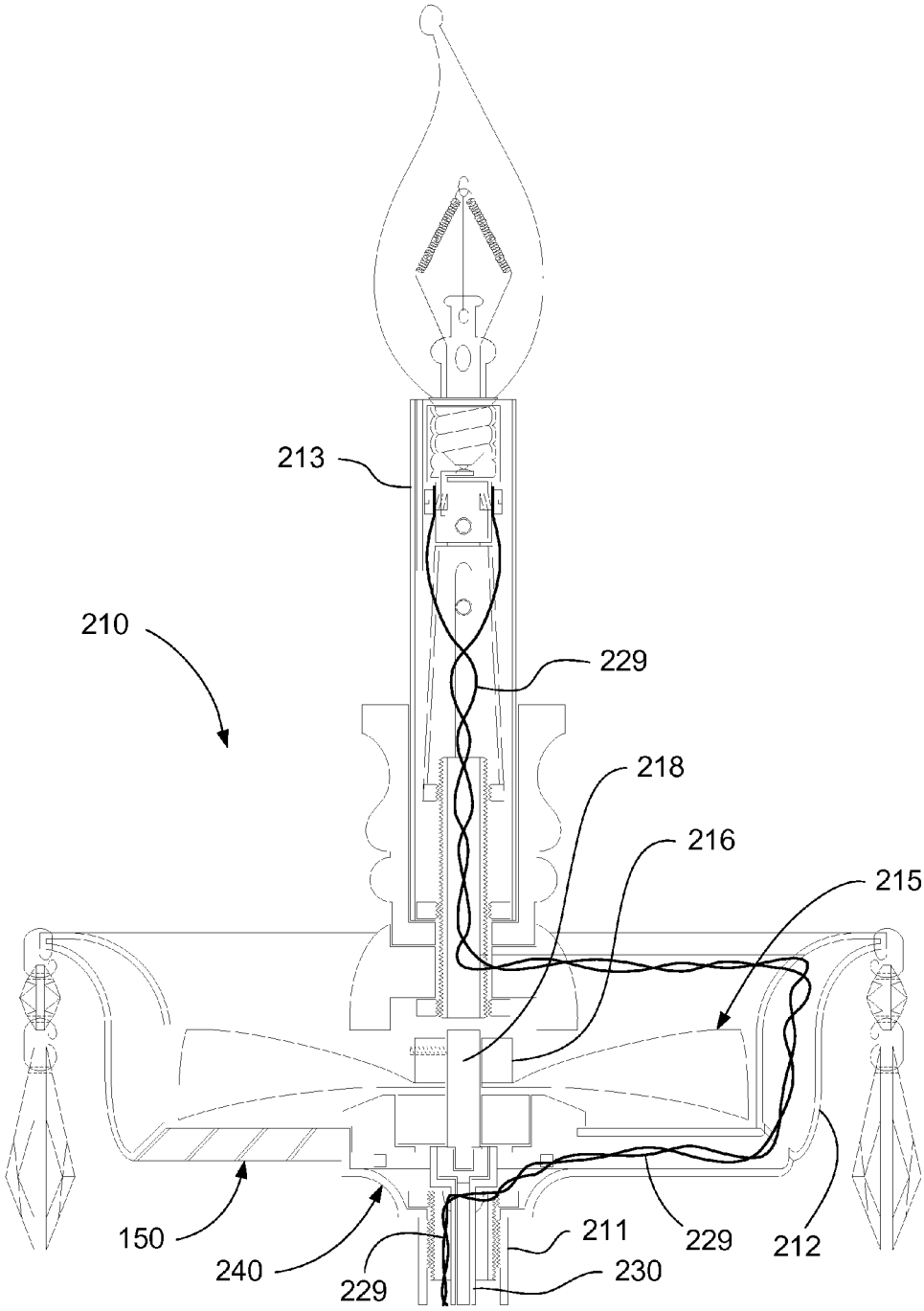
FIGS. 8, 9 detail in partial cross sections alternate drive systems for the satellite fan units of the alternate embodiment of FIG. 6.
Figure 9:
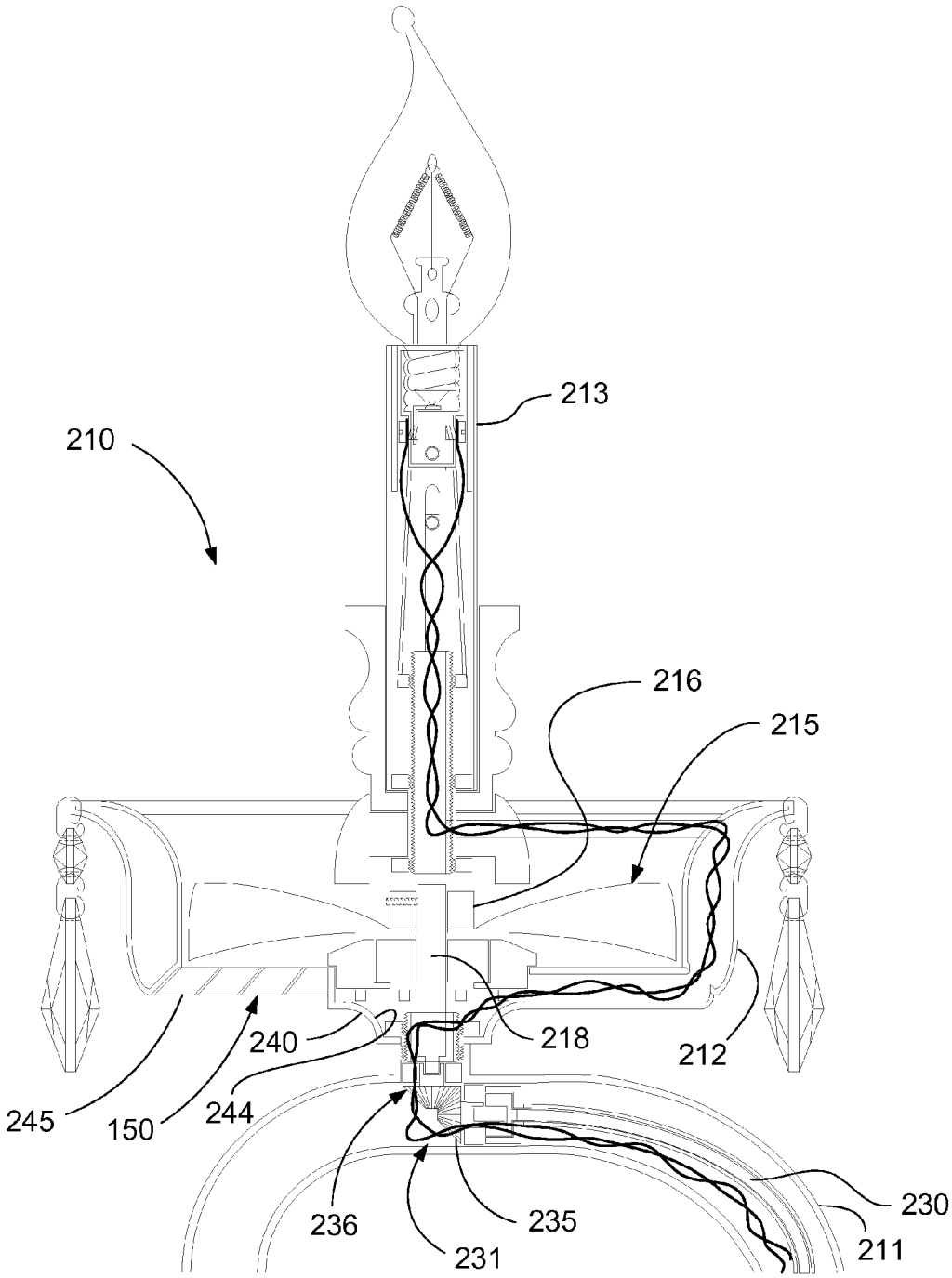

As best seen in FIGS. 4B, 5B, diffusers 150 cast air flow "shadows" 163, 165 within region of influence 161 of fan chandeliers 100, 105, 200. Shadows 163, 165 cause seats 3, but not table 1, to be within the areas most affected by fans 115, 125. This has at least three benefits. First, diners 6 seated within the air flow envelopes 164, 166 experience the beneficial cooling or warming effects of fans 115, 125, thus enjoying the comfort level of a ceiling fan. Second, air flow within envelopes 164, 166 does not pass across food, drink or other materials on table 1, deterring any deleterious effects of such air flow. For example, food will not be unduly cooled, or loose papers will not be blown around, by such air flow otherwise covering the entirety of the area within region 161. Third, effective movement of air is achieved using substantially reduce power requirements when compared to traditional ceiling fans. Thus, the present invention represents a significant improvement over conventional ceiling fans which simply blow air downward toward table 1 in a cone-shaped envelope within region of influence 161 of fan chandelier 100, cooling food and moving papers in the act of providing comfort control to diners 6 in seats 3.

Diffuser Grates

Figure 10A:
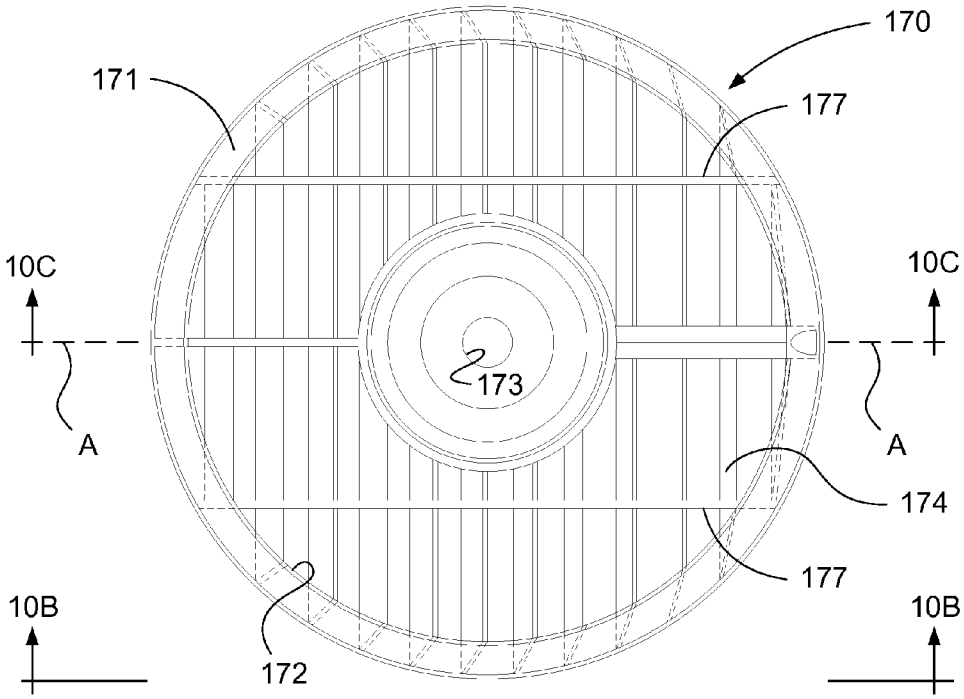
FIGS. 10A-10C show a preferred embodiment of a diffuser grate for use with the satellite fans of the present invention, particularly as depicted in use in FIG. 5A.
Figure 10B:
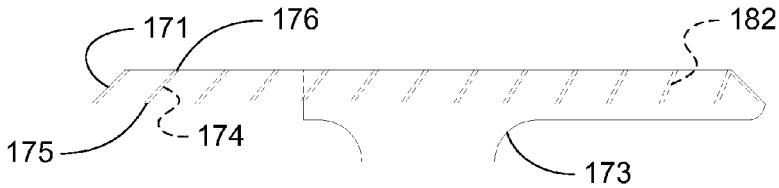
Figure 10C:
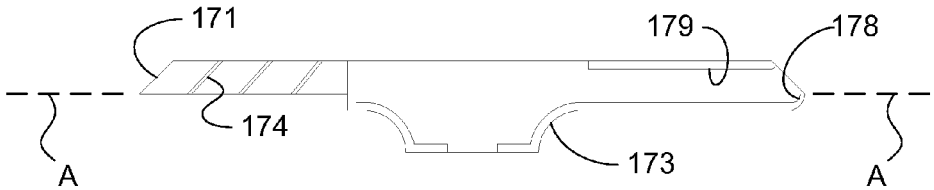
Figure 11A:
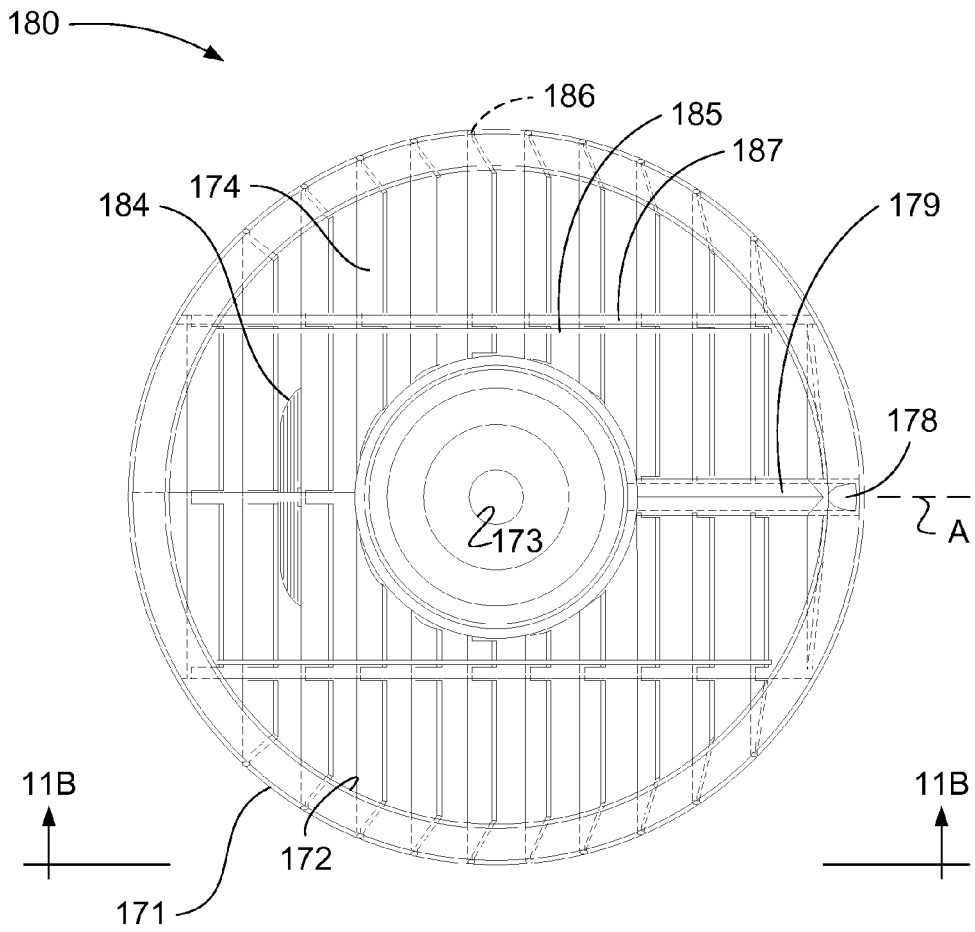
FIGS. 11A-11F show an adjustable variant of the diffuser grate of FIGS. 10A-10C.
Figure 11B:
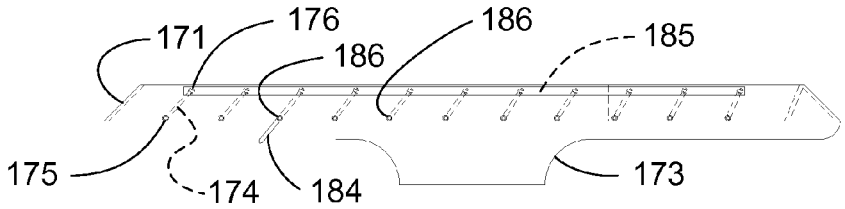
Figure 11E:
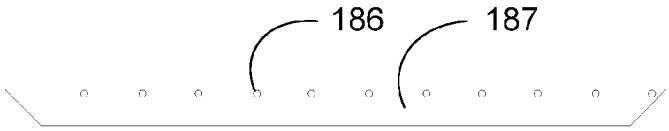
Figure 11F:
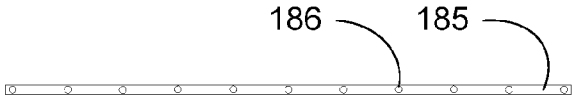
Figure 11C:
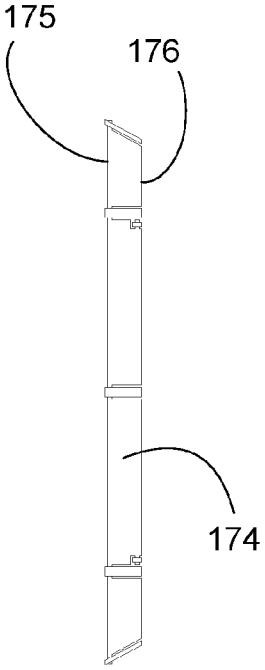
Figure 11D:
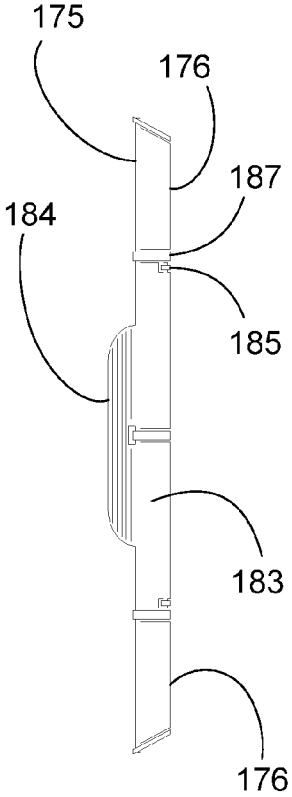

Referring now also to FIGS. 10A-10C, grate 170 comprises a substantially planar array having circular perimeter 171 defining coaxial port 172 through which air flows from fan 115. Grate 170 couples to base 145, 146 by hub interface 173. Wiring channel 179 extends radially along axis A rearward (toward central body 120) from hub interface 173 to terminate in aperture 178 through perimeter 171. Channel 179 and aperture 178 thereby provide a path for wiring 127 (FIG. 3A) to circumvent the blades of fan 115 on its way to serve light unit 113 atop satellite 110.

Grate 170 further includes fixed vanes 174 disposed substantially parallel to each other and forming chordal slats dividing port 172 into substantially rectangular sections transverse to axis A. Braces 177 paralleling axis A stabilize vanes 174 along their length between opposite sides of perimeter 171 and deter a vortex effect upon the air flowing through diffuser 150 otherwise caused by the redirection of the air in such a small space. Forward vanes 174 (farthest from aperture 178, and thus central body 102) are disposed at a relatively shallow angle compared to more rearward vanes 174, their lower edges 175 being substantially more distal hub 173 than their upper edges 176. By contrast, rearward vanes 174 are affixed much more upright, so that their lower edges 175 are disposed more directly beneath their upper edges 176. This arrangement causes air flowing across forward vanes 174 to be directed in a more horizontal direction, thereby defining an outer limit, most distal from central body 102, of region 166 (FIGS. 4B, 5B) affected by satellite 110 fans 115. Rearward vanes 174 by contrast direct air in a more vertical direction to define an inner limit of region 166 closest to central body 102. Grates 170 produce the substantially straight air flow 158 depicted in FIG. 5A.

Referring now to FIGS. 11A-11F, grate 180 comprises a variant of grate 170 having adjustable vanes 174. Like grate 170, grate 180 comprises circular perimeter 171 forming opening 172 divided into substantially rectangular sections by transverse vanes 174. Further, vanes 174 most distal aperture 178 are biased more horizontally than rearward vanes 174 closest to aperture 178. Instead of rigidly affixed to perimeter 171, however, vanes 174 pivotally attach thereto only at their bottom edges by pivots 186. This allows the vertical pitch of vanes 174 to be adjusted, thereby better controlling the direction of air flow 158. Top edges 176 of vanes 174 are affixed relative to each other by linkage 185, causing all of vanes 174 to rotate about pivots 186 in concert when any one of them is adjusted. Handle 184 may be provided on bottom edge 175 of one or more of vanes 174 for convenience in adjusting vanes 174 from beneath. Rigid braces 187 extend parallel axis A and couple to vanes 174 with additional pivots 186 to stabilize vanes 174 longitudinally. This adjustable vane system enables air envelope 166 to be redirected horizontally (FIGS. 4A, 5A) closer to or farther from the vertical centerline of fan chandelier 100 to accommodate tables 1 of different sizes.

Figure 12A:
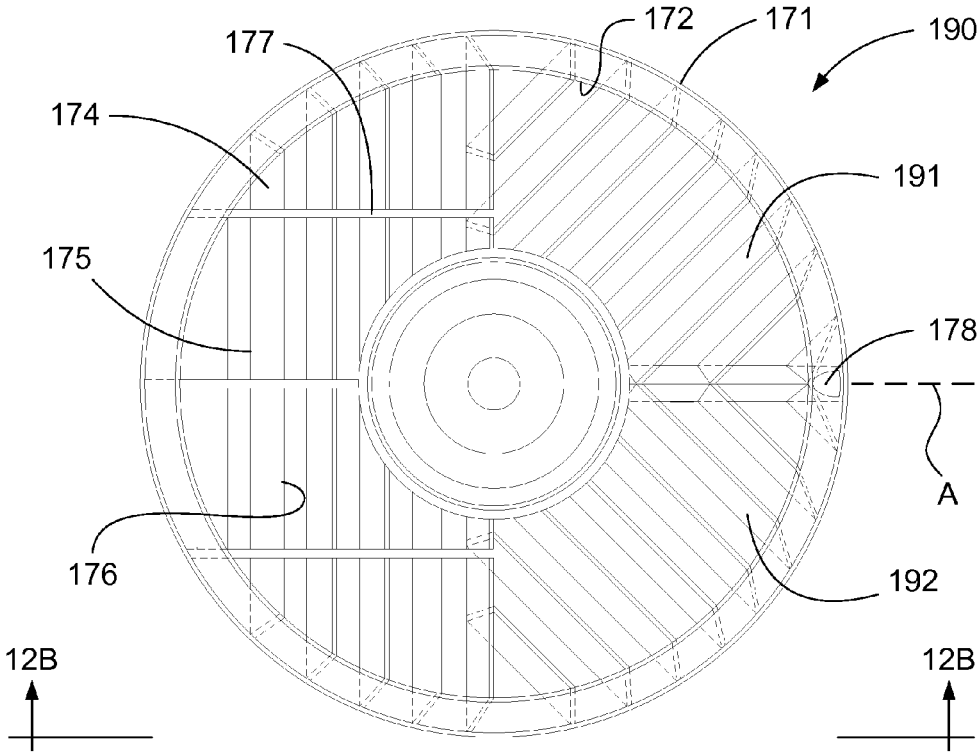
FIGS. 12A-12B show an alternate embodiment of a diffuser grate for use with the satellite fans of the present invention, particularly as depicted in use in FIG. 4A.
Figure 12B:
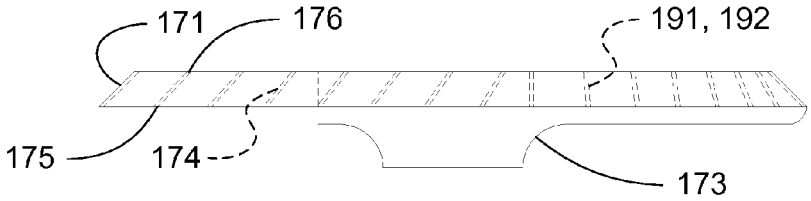

Referring now to FIGS. 12A-12B, grate 190 comprises an alternate embodiment of diffuser 150 having substantially the same configuration as grate 170 except that rearward vanes 191, 192 are disposed at an angle to axis A. Preferably, vanes 191, 192 disposed on opposite sides of axis A are angled approximately ninety (90) degrees to each other with axis A bifurcating said 90 degree angle. This causes vanes 191 and 192 to be disposed at 45 degrees to axis A but angled in opposite directions. Further, the portion of port 172 covered by vanes 191, 192 comprises approximately half of port 172, vanes 191 and 192 each covering substantially equal portions thereof. One having ordinary skill in the art will recognize that the angle between vanes 191, 192 and the portion of aperture 172 they cover may vary significantly without departing from the spirit and scope of the present invention. Grate 190 produces the air flow pattern depicted in FIG. 4A.

Figure 12C:
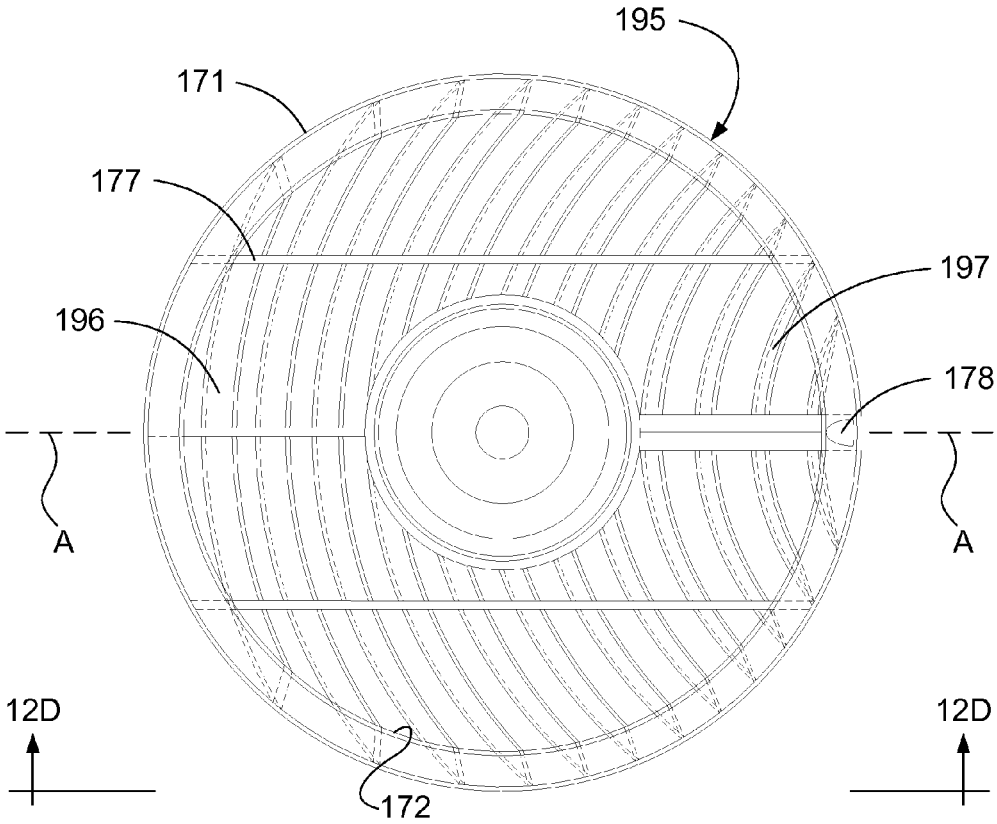
FIG. 12C, 12D show a variant of the diffuser grate of FIGS. 12A-12B having curved vanes.
Figure 12D:
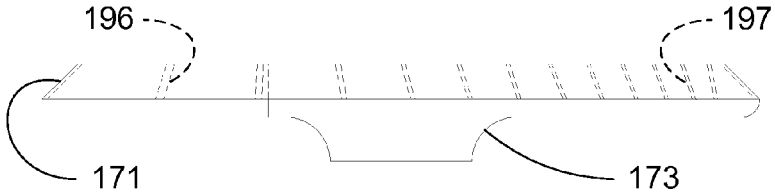

Referring now to FIG. 12C, another alternate diffuser 150 embodiment comprises grate 195 also having circular perimeter 171, but divided by curved vanes 196, 197 instead of straight vanes 174. Forward vanes 196 comprise a larger radius, and thus less curvature, while being pitched most horizontally (with their lower edges extended the farthest), thus directing air most parallel to axis A as depicted in FIG. 4A by arrows 158. By contrast, rearward vanes 197 comprise shorter radius, more curved slats which more closely simulate rearward vanes 191, 192 of diffuser 190. Braces 177 of grate 195 parallel axis A as discussed above for grates 170, 180, 190 to vanes 196, 197 along their length and to suppress twisting of air flowing through grate 195 caused by curved vanes 196, 197. Grate 195 thus produces an air flow pattern similar to that of grate 190, as depicted in FIG. 4A.

Figure 13A:
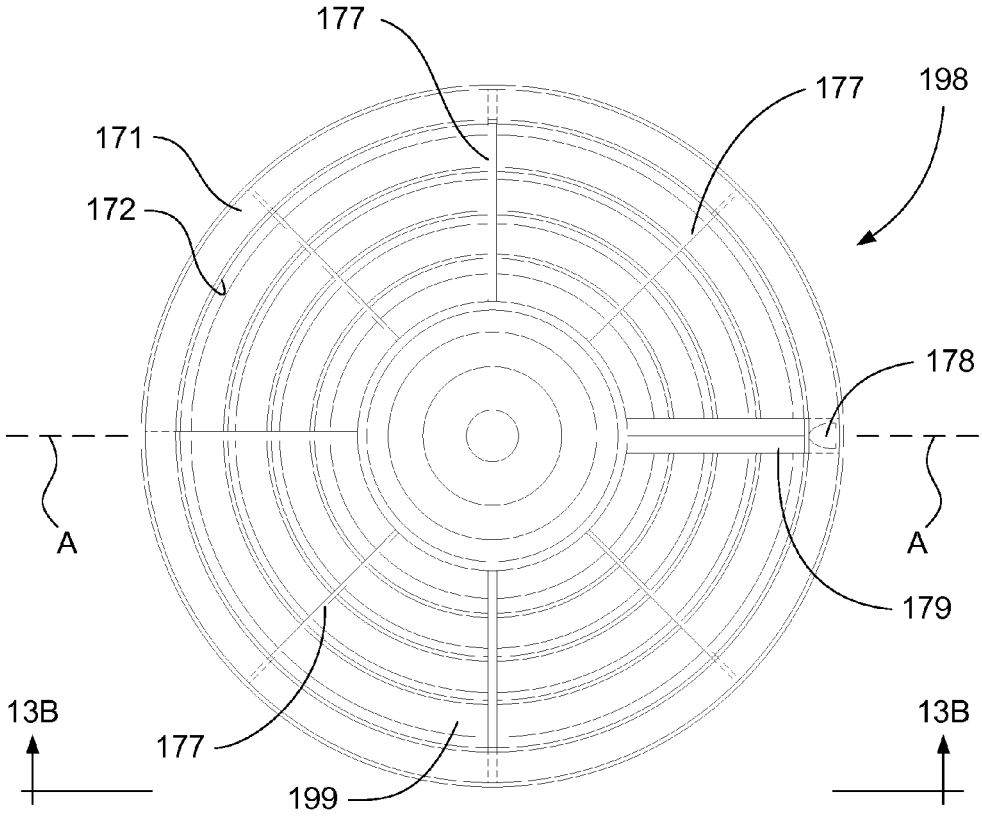
FIGS. 13A-13B show a diffuser grate for use with the central fan of the preferred embodiment of FIG. 1 which employs concentric, curved vanes.
Figure 13B:
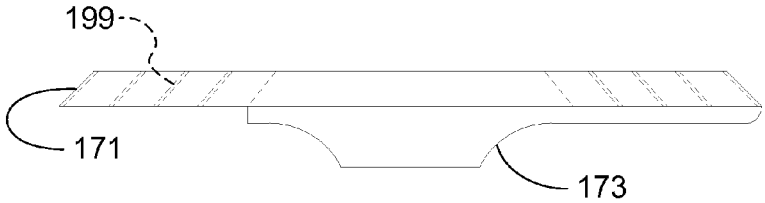

Referring now to FIGS. 13A, 13B, grate 198 comprises a substantially circular diffuser 150 for use with central fan 120. Grate 198 employs circular vanes 199 concentric about base 140, 141 and hub 173. Braces 177 radiate from hub 173 in all directions to divide vanes 199 into even degrees of arc around hub 173. Unlike grates 170, 180 and 190, where lower edges 175 of vanes 174 gradually extend farther from central body 102 than their upper edges 176 as vanes 174 are disposed farther from aperture 178, vanes 199 of grate 198 all are affixed to braces 177 at a consistent angle chosen for the desired directivity of air flow 158, thereby defining undisturbed region 166. Despite this, one having ordinary skill in the art will recognize that vanes 199 could vary in pitch just as do, e.g., vanes 196, 197 discussed above.

Comparing FIGS. 4A and 5A illustrates one reason for usage of different grates 170, 180, 190, 195, 198. In the single-tiered embodiment of fan chandelier 100 depicted in FIG. 4A, concern for interstitial regions between axes A of each of arms 111 leads to the need for the angled directivity of air flow 157 provided by rear vanes 174 of grate 170 and rear vanes 191, 192 of grate 190. By contrast, where the two tiered embodiment of fan chandelier 105 comprises arms 111 extending in a higher plane and bifurcating the angle between arms 111 in the lower plane, less concern arises that the interstitial regions of edge 4 of table 1 will be adequately served. Satellites 110U, 110L both may include straight diffusers 170, 180 which present a single directivity and amplitude to air flow 158.

Crystal Mountings

Crystals 30 on conventional chandeliers typically dangle from simple wire mountings. Though free to pivot from such mountings, crystals 30 seldom do so because air movement through such chandeliers, and any disturbance caused thereby, is minimal. Encouraging air movement through fan chandeliers 100-200, as contemplated by the present invention, however, may generate significant oscillating movement of crystals 30 if they movably dangle. Such movement causes correspondingly increased movement of refracted light rays from lights 113, a largely undesirable effect. Accordingly, specialized crystal 30 connection hardware is useful to suppress such movement, at least where it may become pronounced.

As depicted in the figures (e.g. FIGS. 2A-3C), most crystals 30 may simply dangle from their attachment points without concern about excessive movement. Pronounced movement may occur, however, in at least one embodiment of the present invention. In FIGS. 5A, 5B, multilevel fan chandelier 105 includes upper satellites 110U disposed in a plane above lower satellites 110L. Even though diffusers 150 within satellites 110U employ grates 170 or 180 to direct air flow substantially parallel to arms 111U, and air flow is directed downward by diffusers 150 (FIG. 5B), some horizontal air dispersion occurs anyway. Since satellites 110U are disposed above adjacent satellites 110L, such horizontally dispersed air may flow across crystals 30 mounted on satellites 110L before encountering air movement from satellites 110L which might divert it. Thus, if crystals 30 on satellites 110L are free to dangle, air from satellites 110U may cause them to oscillate unacceptably.

Figure 14A:
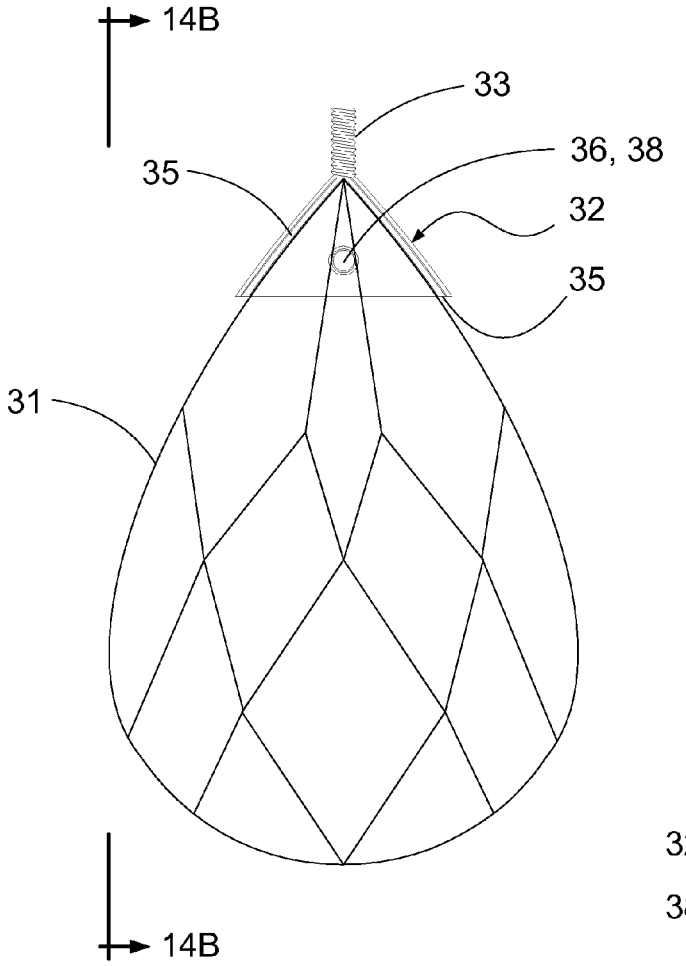
FIGS. 14A, 14B detail a rigid mounting system for light refracting crystals for use with the present invention.
Figure 14B:
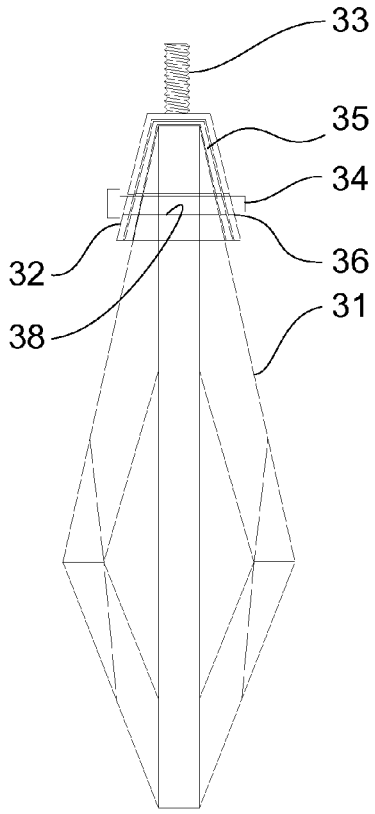

FIGS. 14A-14B depict a system for rigidly mounting crystals 30 such that they cannot move. Crystal 30 in FIGS. 14A, 14B comprises crystal bead 31 suspended from stud 33 by cap 32. Cap 32 comprises a substantially trapezoidal, inverted cup adapted to fit the upper end of bead 31 and hold it snugly and rigidly. One having ordinary skill in the art will recognize that cap 32's shape and size will vary with the shape and size of bead 31. Aperture 36 through bead 31 aligns with aperture 38 through the sides of cap 32, and pin 34 extends through apertures 36, 38 to secure bead 31 to cap 32. Cushioning material 35 may be provided within cap 32 to further dampen any movement of bead 31 relative to cap 32. Stud 33 screws into a threaded receptacle (not shown) provided for the purpose on shroud 112 on satellites 110L. When air from satellite 110U flows across crystals 30 on satellites 110L, crystals 30 will remain substantially immobile at least relative to shroud 112. Pin 34 may be removed for cleaning of bead 31 desired without having to remove cap 32 from shroud 112.

Heating

Figure 15B:
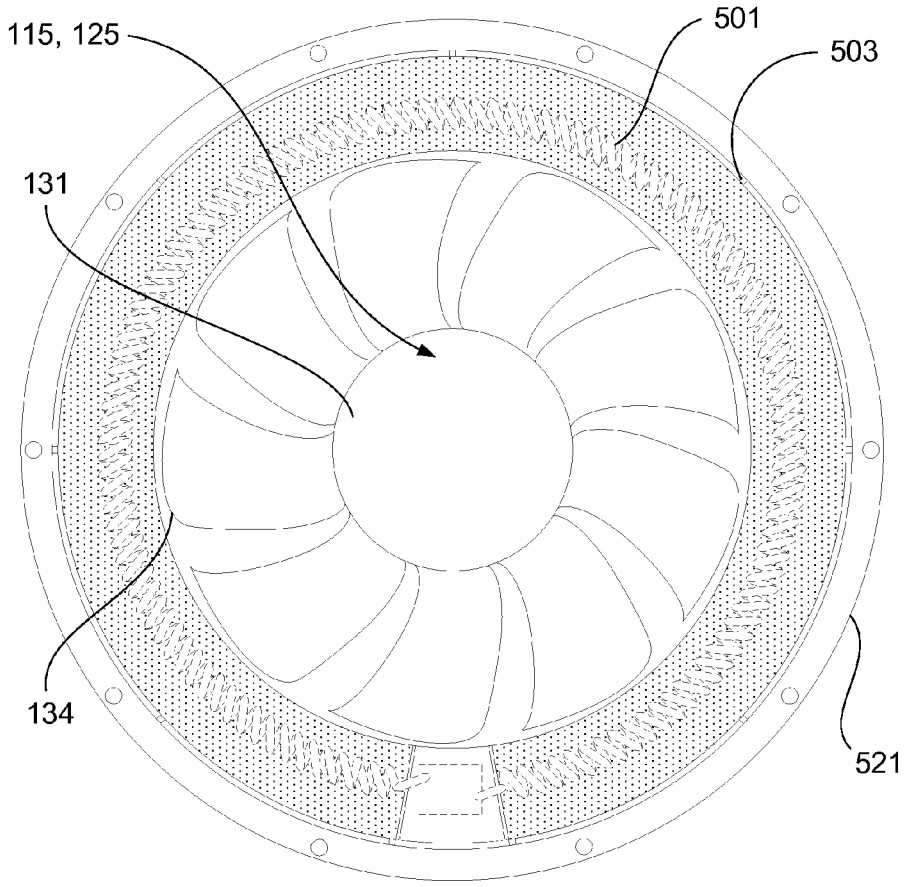
FIGS. 15A-15D detail means for heating air passing through the lighting units of the present invention.
Figure 15A:
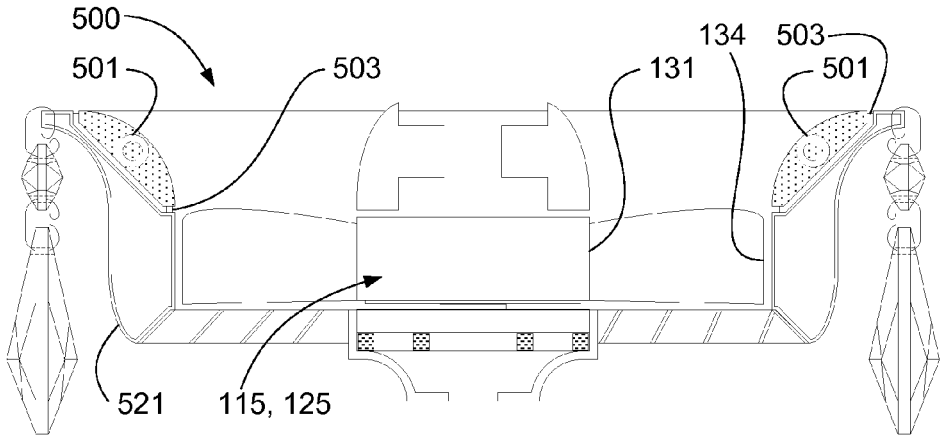
Figure 15D:
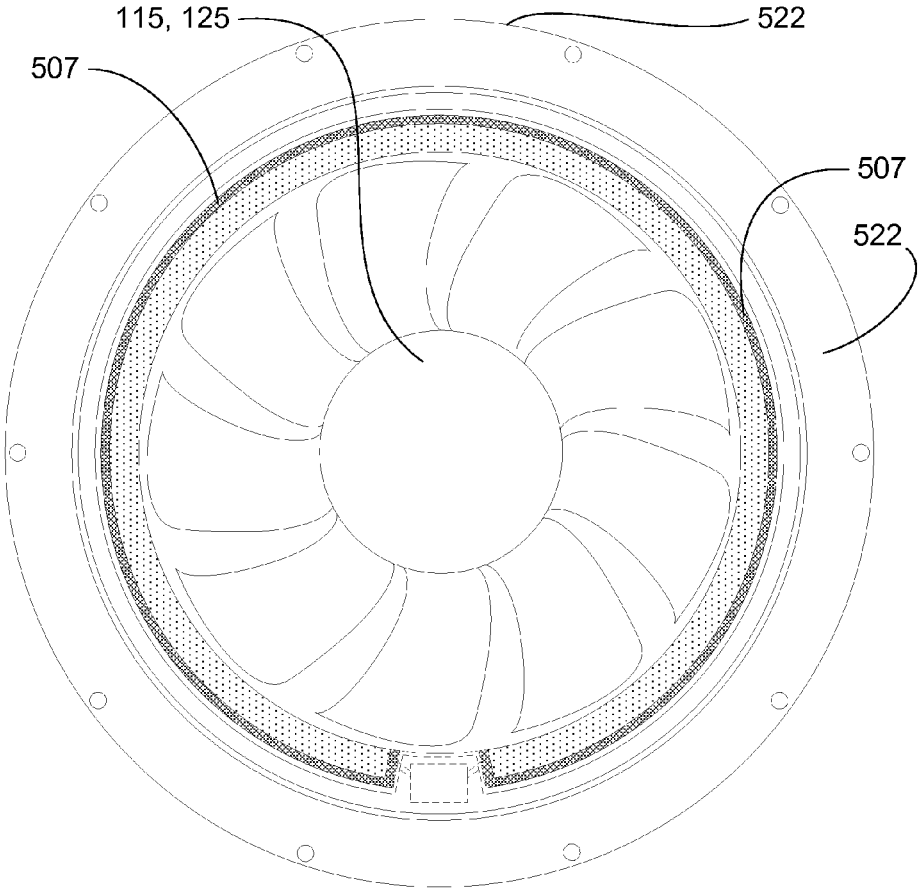
Figure 15C:
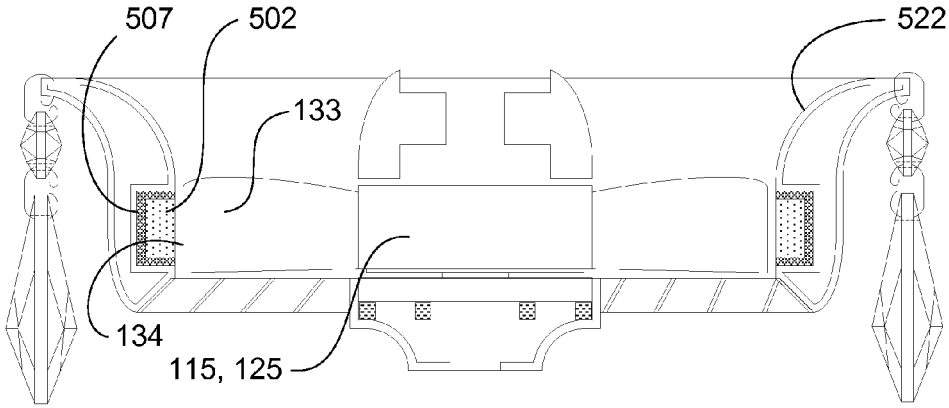

Referring now to FIGS. 15A-15D, air warming means 500 for optional heating of air moved through satellite units 110 and central fan unit 120 comprises annular electric heating coil 501 disposed within the perimeter of shroud 521, 522 just outside edge 134 of fans 115, 125 and coaxial, though not necessarily coplanar, with hub 131. FIG. 15A depicts coil 501 supported by supports 503 above shroud 521, while an alternate embodiment shown in FIG. 15C comprises coil 502 embedded within insulating material 507 and j ournaled within shroud 522 coaxial with fan 115, 125. Insulating material 507 minimizes any hazard of injury from heating shroud 522 in FIGS. 15C, 15D. One having ordinary skill in the art will recognize that alternate positioning of coils 501, 502, such as coaxially with hub 131 but smaller than and positioned above or below (not shown) fans 115, 125, may be achieved without departing from the spirit and scope of the present invention.

Electric power for coils 501, 502 would be provided by wiring (not shown) of appropriate size disposed along with power wiring for fans 115, 125 (if electrically driven) and preferably separately wired and controlled by a separate switch (not shown) either disposed conveniently within the room or mounted on fan chandeliers 100, 105 at an unobtrusive but convenient location within reach from beneath cental body 120. As an alternative, coils 501, 502 within each satellite units 110 could be separately controllable, necessitating location of a switch or rheostat (not shown) conveniently on satellite unit 110 itself, as discussed above for fans 115.

Heating means 500 is not limited to use with fan chandeliers 100, 105 having electrically driven fan motors 115, 125. Heating means 500 also can be used with satellites 210 of alternate embodiment 200 by simply including appropriate wiring (not shown) in arms 211 along with wiring 229 for lights 213.

Heating units 501 preferably comprise band heater strips typically made with NIC80 (80% nickel, 20% chromium) embedded in heat-conductive ceramic cases and shaped for the intended purpose. Preferably, heating units 501 would provide approximately 250 watts maximum each where fan chandeliers 100, 105 having six satellites 110, for a total of approximately 1500 watts, sufficient heating capacity to warm a reasonably sized room of 150 to 200 square feet in a matter of minutes. Suitable heating units 501 may be custom ordered as Duraband heaters from Tempco Electric Heater Corporation of Wood Dale, Ill.

Filtering

Figure 16A:
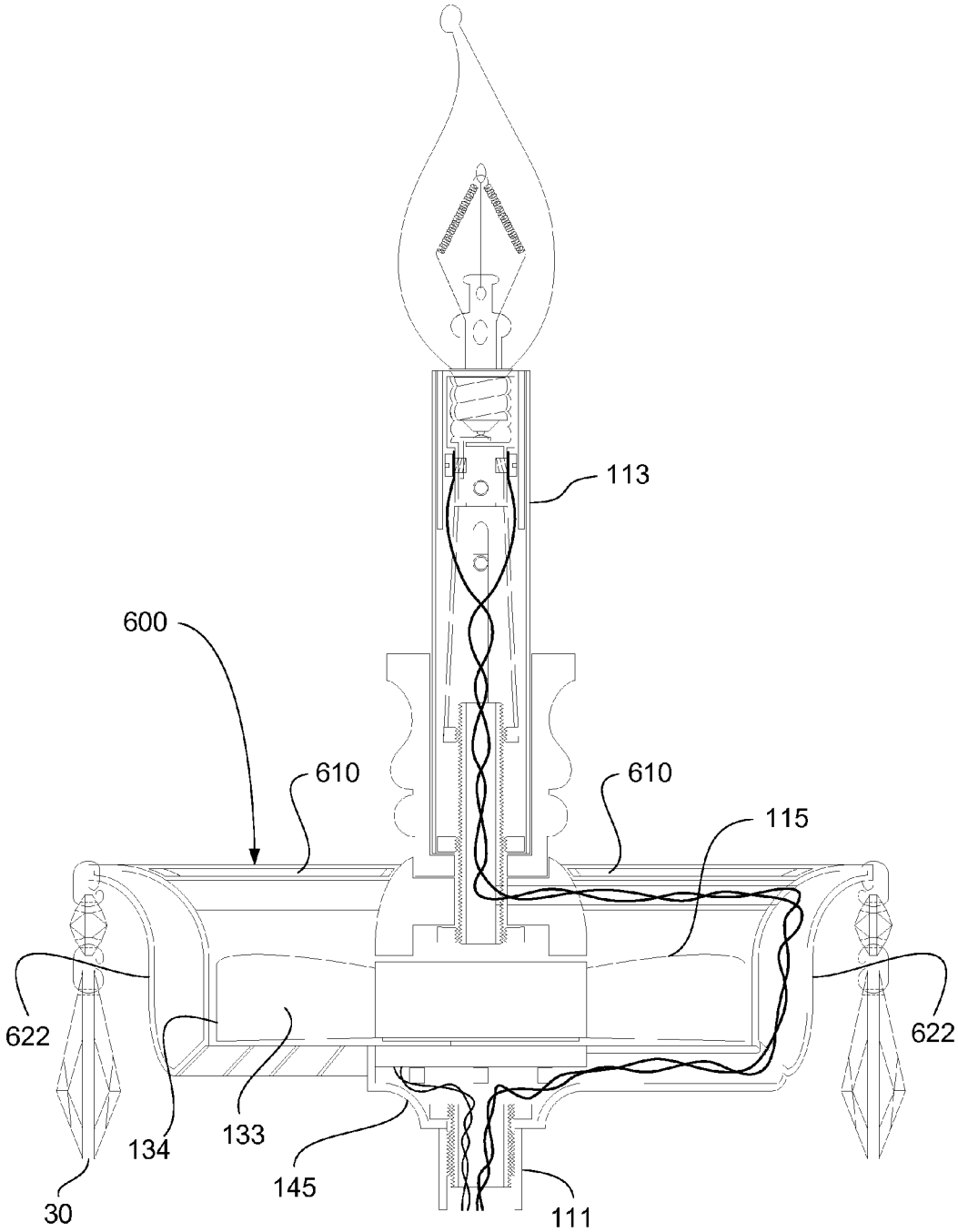
FIGS. 16A-16C detail means by which air may be filtered within the lighting units.
Figure 16B:
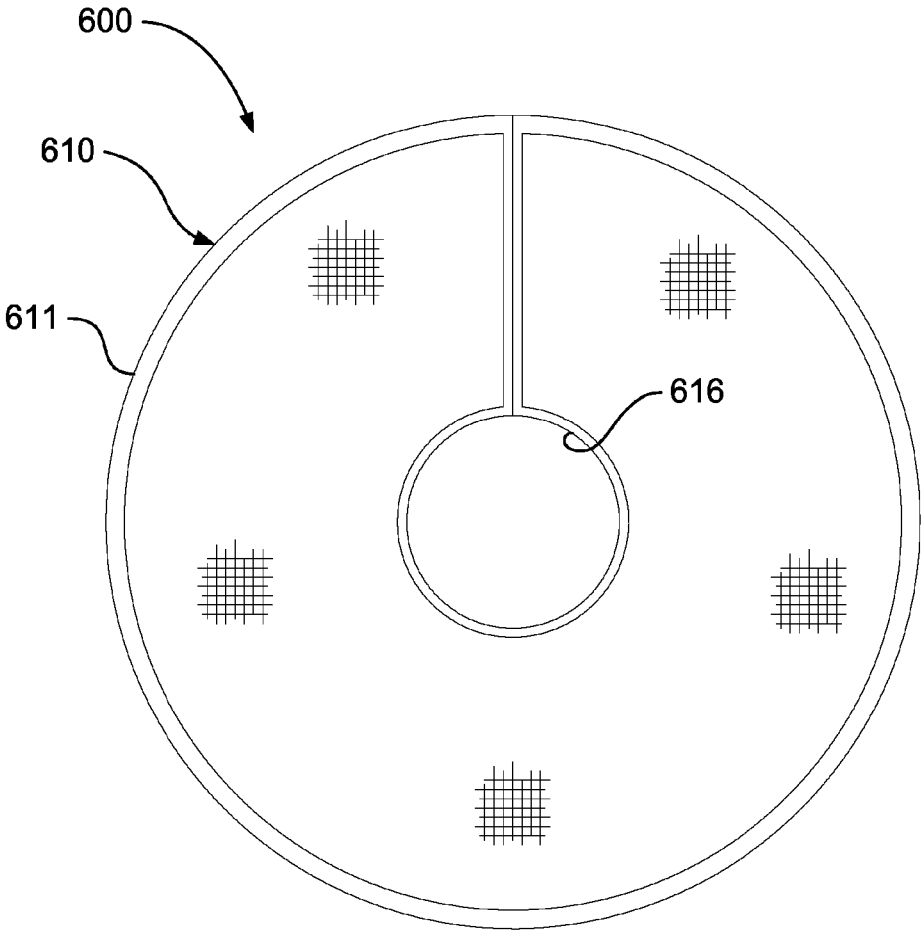
Figure 16C:
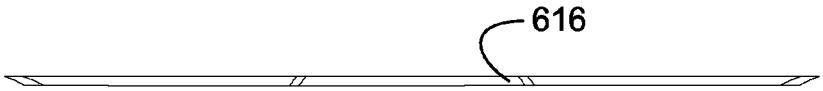

Referring now to FIGS. 16A-16C, filter means 600 for filtering air impelled by fan 615 comprises annular, planar bat of filter material 610 disposed coaxially with shroud 622 above fan 615. Shroud 622 engages at least a portion of the outer edge 611 of filter 610 to prevent its movement due to gravity or movement of air impelled by fan 615. As best seen in FIG. 16B, filter 610 comprises a substantially flat, fibrous disk having central aperture 616 adapted to surround light 113 and slit 618 which parts to admit filter 610 around light 113 without having to thread it over the end thereof. One having ordinary skill in the art will recognize that filter means 600 depicted in FIG. 16 for use in satellites 110, 210 also could be included into central fan unit 120 without departing from the spirit and scope of the present invention.

Filter means 600 may include activated carbon for air purification as well as for removal of odors and particulate matter from the air. A suitable carbon filter is available as Hunter 30901 from Alergy Be Gone of Brooklyn, N.Y.

Operation

In operation, fan chandeliers 100, 105 preferably are turned on using separate wall switches (not shown) for lights 113, fans 115, 125 and, when provided, heating means 500. Where such wall switches are simple on/off switches, the comfort of diners 6 in seats 3 may be regulated by turning on fan 125, fans 115 or both, with or without heating from heating means 500. Illumination to table 1 is provided by turning on lights 113.

Where rheostats such as switches 128 (FIG. 1) or wall switches (not shown) are provided, additional control is available. Specifically, illumination from lights 113 may be reduced to any level between full bright and off. Rheostats for fans 115, 125 allow regulating the rpm's of fan 125 and of fans 115 (together) to vary the air flow within envelopes 164, 166 respectively. Rheostat control of heating means 500 may allow further refinement of the comfort of persons 6 seated at table 1. When the proper comfort level is achieved, no further adjustment is needed. Similarly, control switches (not shown) for fan chandeliers 200 may be operated separately to achieve optimum comfort and illumination.

The present invention, described in either its preferred or alternate embodiments, thus serves the purpose of both a ceiling fan and a chandelier. Whereas a homeowner or other owner traditionally must choose between a handsome, showy chandelier or central air movement from a ceiling fan, fan chandeliers 100, 105, 200 provide an alternative where both are provided. Fancy chandeliers bearing many light refracting crystals 30 may grace the center of a room while fans concealed within the chandelier circulate air for optimal comfort, smoke and heat dispersal and other motives. Where air movement is not needed, the present invention provides a traditional chandelier. Where illumination is not needed, the present invention provides air movements as with any ceiling fan. Where both are needed, both are available.

While the invention has been particularly shown and described with reference to one or more embodiments, it will be understood by those skilled in the art that various changes in form and detail may be made therein without departing from the spirit and scope of the invention. For example, fans 115, 125, 215 largely have been discussed above as impelling air vertically downward toward table 1, they also may be designed for two-way operation, where air is drawn upward and impelled away from table 1. This maybe achieved by providing motors 117 which turn in the desired direction, or by affixing appropriately angled blades 133 to hub 131. Alternately, reversible-direction motors 117 may achieve reversible air flow in any of the devices discussed.

Further, the invention has been discussed as being used with table 1 where shadows 163, 165 are desirable traits. The present invention could be used in a more traditional ceiling fan situation where uniform dispersion of air is a more desirable outcome. This can be achieved by simply using diffusers 150 having broader air flow patterns, such as diffuser grate 198 having concentric vanes that distribute air in a 360 degree pattern.

Finally, the present invention has been discussed above as having satellite units 110 bearing fans 115 and lights 113, whether or not central fan 125 also is included and coupled to central body 102. Instead, however, the present invention can comprise central body 102 bearing central fan 125 whether or not satellite units 110 also are present and disposed at the ends of arms 111, the latter being unnecessary if satellite units 110 are not included.

| | General Options | Examples/Catalog # |
|---|---|---|
| Motor Placement | Multiple motors integrated in fans (i.e. case fans, computer fans, etc.) | NMB-MAT 4715F5-12T-B50-D00 Case Fan - Satellite Units (AC)<br>NMB-MAT 5915PC-12T-B20-A00 - Center Unit (AC)<br>NMB-MAT 4710KL-05W-B50 - Satellite Units (DC Option)<br>NMB-MAT 682PL-05W-B70 - Center Unit (DC Option) |
| | Single motor integrated in fixture | 1/8 HP PSC High Efficiency Ring/Stud Mount Blower Motor, 3 Speed, 1075 Max RPM, Grainger Stock # 4UY17 with a 1:2.8 Gearbox |
| | Single motor remotely mounted outside fixture (against ceiling, in attic, etc.) | Motor from MinkaAire, Mystique, Model No. F611, 3 Speed (65, 107, and 163 RPM) with a 1:18.4 Gearbox |
| | Multiple motors integrated in fixture | Uncased Small Fan Motor, 1/70 HP, 3000 RPM |
| | Combination of above options | Grainger Item Number 3M566 |
| Fan Placement | Candlestick Fans (located at the lights) | |
| | Center Fan (located in the main body of the fixture) | |
| | Combination of above options | |
| Fan Type | Axial or Propeller Fan | NMB-MAT 4715FS-12T-B50-D00 Case Fan - Light Units (AC)<br>NMB-MAT 5915PC-12T-B20-A00 - Center Fan Unit (AC)<br>NMB-MAT 4710KL-05W-B50 - Satellite Units (DC Option)<br>NMB-MAT 682PL-05W-B70 - Center Unit (DC Option)<br>PM Motor Fan Blade Co., Part # 4LHF.250-W<br>Air-Drive, Inc., 10 Wing Fan, Part # AD10-5.00-CC-B-37-0.25 |
| | Centrifugal (Radial) Fan | Air-Drive, Inc., Bi-Directional, 12 Petals, Radial Blade, Part # AD-4.75-CC-B-90-0.25 or<br>Air-Drive, Inc., 8 Petals, Radial Blade, Part # AD-6.25-CC-B-90-0.25 |
| | Mixed Flow Fan | |
| | Combination of the above options | |
| Diffuser | Slats at Different Angles, Louvers, Grills, etc. (Internal/External) | |
| | Cone (Straight, Elliptical, etc.) | |
| | None or Combination of the above options | |
| Bevel Gear<br>Optional (Design Dependent) | Solid Shaft | S.S. White Technologies, Ratio Drive, Gear Ration 1:1, Right Angle Light Duty, Part # FGII8V |
| | Hollow Core to allow electrical wiring through shaft | |
| Flexible Cable<br>Optional (Design Dependent) | Solid Shaft | S.S. White Technologies, Steady-Flex, Bi-Directional Flexible Shaft, Part # FR130SLPCC01800 |
| | Hollow Core to allow electrical wiring through shaft | Suhner Manufacturing Inc., Hollow Center Core Flexible Shaft, Part # A-250-4143 |
| Crystals<br>Optional (Design Dependent) | Normal Mounting-strategically placed out of the airstream | |
| | Single Point Rigidly Mounted | Compression Fitting, Hook Fitting, Slot Fitting, Slide Fitting, or Screw Fitting |
| Filter<br>Optional (Design Dependent) | Dust Collection<br>Oder Elimination | Filter Material- Hunter 30901 from Alergy Be Gone of Brooklyn, New York |
| Heater<br>Optional (Design Dependent) | Heater Band along sides<br>Heater Bands above Fan | Duraband Heaters from Tempco Electric Heater Corporation Of Wood Dale, Illinios |

I claim:

1. A fan chandelier comprising a central body having a vertical axis extending between a lower end and an upper end;

a ceiling mount coupled to the upper end and adapted to mount to a ceiling;

a plurality of satellite units arrayed around the central body, each satellite unit having an arm coupled between the central body and the satellite unit;

a base disposed at an end of the arm distal the central body;

a satellite fan disposed coaxially above and supported by the base;

a shroud coaxial with and surrounding the satellite fan;

a light disposed above the satellite fan and supported by the shroud; and an annular heater strip disposed coaxial with the fan blades and adapted to control the temperature of air passing across the fan.

2. The fan chandelier according to claim 1 and further comprising a central fan disposed on the central body and adapted to rotate coaxial with the central body; and a diffuser grate disposed below the central fan, the grate having concentric vanes adapted to disperse air from the central fan in a generally downward and horizontally outward direction from the central body.

3. The fan chandelier according to claim 1 and further comprising an electric motor housed within the base and coupled to the satellite fan; and speed control means for controlling the speed of each of the satellite fans independently of the other satellite fans.

4. The fan chandelier according to claim 1 and further comprising an electric motor disposed coaxially with the central body and having an armature shaft;

a transmission disposed on the central body and coupled to the electric motor by the armature shaft, the transmission having a single drive gear mounted coaxially with the armature shaft; and a plurality of satellite gears enmeshed with the drive gear; and flexible drive cables coupled to the satellite gears and extending through the arms to couple to the satellite fan means whereby the electric motor drives each of the satellite fan means simultaneously.

5. The fan chandelier according to claim 1 and further comprising a diffuser grate disposed on each satellite and adapted to diffuse air from the satellite fan, the grate having a perimeter surrounding and defining an aperture adapted to channel air flowing from the satellite fan;

a plurality of vanes traversing the aperture and dividing the aperture into narrow sections; and a plurality of braces disposed transverse the vanes, the braces adapted to divide the narrow sections to deter turbulence in the air passing through the grate.

6. The fan chandelier according to claim 5 and further comprising a central hub disposed coaxial with the aperture and coupled to the perimeter, the hub adapted to mount the grate to the base; and a wiring channel extended from the central hub to the perimeter and adapted to provide a conduit for wiring to circumvent the fan.

7. The fan chandelier according to claim 1 and further comprising a plurality of decorative crystals rigidly coupled to the fan chandelier and adapted to refract and disperse light emitted from the lighting means without the crystals being moved by air flowing from the satellite fans.

8. The fan chandelier according to claim 7 wherein a plurality of the decorative crystals further comprises a cap coupled to each of the crystals, the cap surrounding and engaging a portion of the crystal and having a transverse aperture adapted to receive a pin;

a pin adapted to be journaled through the transverse aperture and a matching pin aperture in the crystal; and an attachment disposed on the cap and adapted to rigidly attach the crystal to the fan chandelier.

9. The fan chandelier according to claim 1 and further comprising filter means disposed on top of the satellite units and adapted to remove contaminants from air passing through the satellite fans.

10. A fan chandelier adapted to both illuminate and regulate air temperature in a room, the room having a ceiling, the fan chandelier comprising a central body extending along a vertical axis between lower and upper ends;

a ceiling mount coupled to the upper end and adapted to mount the fan chandelier to the ceiling;

a central fan disposed coaxial with the central body; and a plurality of satellite units coupled to the central body, each satellite unit having an elongate arm coupled to and extending radially from the central body;

a base disposed on an end of the arm opposite the central body;

a satellite fan disposed above the base;

a shroud surrounding the satellite fan;

a light disposed above the satellite fan and supported by the shroud; and a filter disposed on top of each fan and adapted to filter contaminants from air passing through the fan.

11. The fan chandelier according to claim 10 and further comprising a plurality of decorative crystals disposed on the satellite units, each decorative crystal having a refractive bead and mounting means for mounting the bead to the satellite unit.

12. The fan chandelier according to claim 11 wherein at least one of the decorative crystals is rigidly mounted to the satellite unit whereby the crystals cannot be moved by air flowing from the satellite fans.

13. The fan chandelier according to claim 10 and further comprising an annular heater strip disposed coaxial with the satellite fan and adapted to selectively control the temperature of the air passing over the satellite fan.

14. The fan chandelier according to claim 10 and further comprising a filter disposed on the central fan and adapted to filter contaminants from air passing through the central fan.

15. The fan chandelier according to claim 10 and further comprising a plurality of decorative crystals disposed on the satellite unit, each decorative crystal having a refractive bead; and mounting means for rigidly mounting the bead to the satellite unit; and a substantially planar filter disposed on top of the shroud and adapted to filter contaminants from air passing through the satellite fan; and an annular heater strip disposed coaxial with the satellite fan and within the shroud and adapted to selectively control the temperature of the air passing over the satellite fan.

16. A fan chandelier adapted to both light and regulate the air temperature of a room, the room having a ceiling, the fan chandelier comprising a central body extending along a vertical axis between lower and upper ends;

a ceiling mount coupled to the upper end and adapted to mount the fan chandelier to the ceiling;

a plurality of satellite units coupled by elongate arms radially around the central body, each satellite unit having a base disposed on an end of the arm opposite the central body;

a satellite fan disposed coaxially above the base and surrounded by a satellite shroud; and a diffuser grate disposed below and coaxial with the satellite fan;

a light disposed above the satellite fan and supported by the satellite shroud;

a plurality of decorative crystals disposed on the satellite unit, each decorative crystal having a refractive bead; and mounting means for mounting the bead to the satellite unit;

a substantially planar filter disposed on top of the shroud and adapted to filter contaminants from air passing through the satellite fan; and an annular heater strip disposed coaxial with the satellite fan and within the shroud and adapted to selectively control the temperature of the air passing over the satellite fan.

17. An improved method of controlling the comfort of a room, the room having a ceiling, the method comprising providing at least one fan chandelier hanging from the ceiling, each of the at lest one fan chandeliers having a central body extending along a vertical axis between lower and upper ends;

a plurality of satellite units arrayed around the central body on distal ends of radial arms coupled to the shroud, each satellite unit having a base disposed an end of the arm;

a satellite fan disposed coaxially above and supported by the base and surrounded by a satellite shroud;

a diffuser disposed below the satellite fan;

lighting means disposed above the satellite shroud coaxial with the satellite fan; and light refracting decoration means disposed on the satellite shroud and adapted to refract light emitted by the lighting means;

providing fan control means for controlling a speed and volume output of air from each of the satellite fans;

providing light control means for controlling a light level emitted by each of the lighting means; then operating the fan control means to set a desired volume out put of air from each of the satellite fans; and operating the light control means to set a light emission level of each of the lighting means.

18. The improved method of claim 17 wherein the fan control means comprises a rheostat disposed on each of the satellite fans for controlling the satellite fans individually; and the operating the fan control means step includes operating each rheostat to control the air output volume of each satellite fan individually.

19. The improved method of claim 17 and further comprising the steps of providing heating means within each of the satellite units for controlling the temperature of the volume of air output by the satellite fan, the heating means including heat control means for regulating heat output from the heating means; and operating the heat control means to regulate heat output from the heating means.

20. A fan chandelier comprising a central body having a vertical axis extending between a lower end and an upper end;

a ceiling mount coupled to the upper end and adapted to mount to a ceiling;

a plurality of satellite units arrayed around the central body, each satellite unit having an arm coupled between the central body and the satellite unit;

a base disposed an end of the arm distal the central body;

satellite fan means disposed coaxially above and supported by the base;

a diffuser grate disposed on the satellite fan means and having a perimeter surrounding and defining an aperture adapted to channel air flowing from the satellite fan;

a plurality of vanes traversing the aperture and dividing the aperture into narrow sections; and a plurality of braces disposed transverse the vanes, the braces adapted to divide the narrow sections to deter turbulence in the air passing through the grate;

a plurality of pivots coupling at least two of the vanes to the perimeter and to the braces, the pivots adapted to allow the vanes to articulate between a plurality of vertical positions; and at least one link pivotally coupled to the at least two of the vanes and adapted to couple together the at least two vanes wherein all vanes coupled to the at least one link articulate simultaneously; and lighting means coupled to the central body for emitting light from the fan chandelier.

21. The fan chandelier according to claim 1 and further comprising fan control means for controlling the speed of air movement generated by each individual satellite unit.

22. A fan chandelier adapted to both light and regulate the air temperature of a room, the room having a ceiling, the fan chandelier comprising a central body extending along a vertical axis between lower and upper ends;

a ceiling mount coupled to the upper end and adapted to mount the fan chandelier to the ceiling;

a central shroud coaxial with the central body;

a plurality of satellite units coupled by elongate arms radially around the central body, each satellite unit having a base disposed on an end of the arm opposite the central body;

a satellite fan disposed coaxially above the base and surrounded by a satellite shroud;

a diffuser grate disposed below and coaxial with the satellite fan; and a light disposed above the satellite fan and supported by the satellite shroud.

23. The fan chandelier according to claim 22 and further comprising an annular heater strip disposed coaxial with at least one of the satellite fans and within its satellite shroud and adapted selectively to heat the air passing over the satellite fan.

24. A fan chandelier adapted to cool and light a room, the fan chandelier comprising a central body having a vertical axis extending between a lower end and an upper end;

a mount coupled to the upper end and adapted to support the central body;

lighting means coupled to the central body for emitting light from the fan chandelier; and a plurality of satellite units arrayed around the central body, each satellite unit having an arm coupled between the central body and the satellite unit;

a base disposed at an end of the arm distal the central body;

a satellite fan disposed coaxially above and supported by the base and adapted to generate air movement;

a shroud coaxial with and surrounding the satellite fan and adapted to partially conceal the fan, whereby the shroud channels all the air movement generated by the fan.

25. The fan chandelier according to claim 24 and further comprising a diffuser grate disposed below at least one of the shrouds, the diffuser grate having a perimeter surrounding and defining an aperture coextensive with the shroud;

a plurality of vanes pivotally coupled to the perimeter and traversing the aperture;

at least one link pivotally coupled to at least two of the vanes and adapted to cause the at least two vanes to articulate simultaneously.

26. A fan chandelier comprising a central body having a vertical axis extending between a lower end and an upper end;

a ceiling mount coupled to the upper end and adapted to mount to a ceiling;

a plurality of satellite units arrayed around the central body, each satellite unit having an arm coupled between the central body and the satellite unit;

a base disposed at an end of the arm distal the central body;

a satellite fan disposed coaxially above and supported by the base;

a shroud coaxial with and surrounding the satellite fan; and a light disposed above the satellite fan and supported by the shroud;

a central fan disposed on the central body and adapted to rotate coaxial with the central body; and a diffuser grate disposed below the central fan, the grate having concentric vanes adapted to disperse air from the central fan in a generally downward and horizontally outward direction from the central body.

27. A fan chandelier comprising a central body having a vertical axis extending between a lower end and an upper end;

a ceiling mount coupled to the upper end and adapted to mount to a ceiling;

a plurality of satellite units arrayed around the central body, each satellite unit having an arm coupled between the central body and the satellite unit;

a base disposed at an end of the arm distal the central body;

a satellite fan disposed coaxially above and supported by the base;

a shroud coaxial with and surrounding the satellite fan;

a light disposed above the satellite fan and supported by the shroud; and a diffuser grate adapted to diffuse air from the satellite fan, the grate having a perimeter surrounding and defining an aperture adapted to channel air flowing from the satellite fan;

a plurality of vanes traversing the aperture and dividing the aperture into narrow sections; and a plurality of braces disposed transverse the vanes, the braces adapted to divide the narrow sections to deter turbulence in the air passing through the grate.

28. The fan chandelier according to claim 27 and further comprising a central hub disposed coaxial with the aperture and coupled to the perimeter, the hub adapted to mount the grate to the base; and a wiring channel extended from the central hub to the perimeter and adapted to provide a conduit for wiring to circumvent the fan.

29. A fan chandelier comprising a central body having a vertical axis extending between a lower end and an upper end;

a ceiling mount coupled to the upper end and adapted to mount to a ceiling;

a plurality of satellite units arrayed around the central body, each satellite unit having an arm coupled between the central body and the satellite unit;

a base disposed at an end of the arm distal the central body;

a satellite fan disposed coaxially above and supported by the base;

a shroud coaxial with and surrounding the satellite fan;

a light disposed above the satellite fan and supported by the shroud; and filter means disposed on top of each of the satellite units and adapted to remove contaminants from air passing through the satellite fans.

30. A fan chandelier adapted to both illuminate and regulate air temperature in a room, the room having a ceiling, the fan chandelier comprising a central body extending along a vertical axis between lower and upper ends;

a ceiling mount coupled to the upper end and adapted to mount the fan chandelier to the ceiling;

a central fan disposed coaxial with the central body; and a plurality of satellite units coupled to the central body, each satellite unit having an elongate arm coupled to and extending radially from the central body;

a base disposed on an end of the arm opposite the central body;

a satellite fan disposed above the base;

a shroud surrounding the satellite fan;

a light disposed above the satellite fan and supported by the shroud; and an annular heater strip disposed coaxial with the satellite fan and adapted to selectively control the temperature of the air passing over the satellite fan.

31. The fan chandelier according to claim 30 and further comprising a plurality of decorative crystals disposed on the satellite unit, each decorative crystal having a refractive bead; and mounting means for rigidly mounting the bead to the satellite unit.

* * * * *